US005316652A

United States Patent [19]

Sagiyama et al.

[11] Patent Number: 5,316,652

[45] Date of Patent: May 31, 1994

[54] METHOD FOR MANUFACTURING IRON-ZINC ALLOY PLATED STEEL SHEET HAVING TWO PLATING LAYERS AND EXCELLENT IN ELECTROPAINTABILITY AND PRESSFORMABILITY

[75] Inventors: Masaru Sagiyama; Masaki Abe; Akira Hiraya; Junichi Inagaki; Masaya Morita, all of Tokyo, Japan

[73] Assignee: NKK Corporation, Tokyo, Japan

[21] Appl. No.: 20,657

[22] Filed: Feb. 22, 1993

Related U.S. Application Data

[63] Continuation-in-part of Ser. No. 764,010, Sep. 23, 1991, abandoned.

[30] Foreign Application Priority Data

Oct. 8, 1990 [JP] Japan ..... 2-270171

[51] Int. Cl.[5] ..... C25D 5/00

[52] U.S. Cl. ..... 205/177; 205/184; 427/433

[58] Field of Search ..... 205/177, 184, 206; 427/433

[56] References Cited

U.S. PATENT DOCUMENTS

| | | | |
|---|---|---|---|
| 4,329,402 | 5/1982 | Hyner et al. | 428/621 |
| 4,491,623 | 1/1985 | Kokubo et al. | 428/658 |
| 4,510,209 | 4/1985 | Hada et al. | 428/659 |
| 4,629,659 | 12/1986 | Kyono et al. | 428/659 |
| 4,818,632 | 4/1989 | Hsu et al. | 428/613 |
| 4,839,241 | 6/1989 | Abe et al. | 428/659 |
| 4,853,295 | 8/1989 | Shindo et al. | 428/659 |
| 4,908,279 | 3/1990 | Yusuke et al. | 428/659 |
| 5,059,455 | 10/1991 | Hasselbach et al. | 205/206 |

FOREIGN PATENT DOCUMENTS

| | | |
|---|---|---|
| 58-15554 | 3/1983 | Japan . |
| 2-66148 | 3/1990 | Japan . |
| 2-85393 | 3/1990 | Japan . |

OTHER PUBLICATIONS

Patent Abstracts of Japan, vol. 14, No. 246(C-722) (4189), May 25, 1990, of JP 2-66148, Japan.

Patent Abstracts of Japan, vol. 9, No. 12 (C-261) (1735), Jan. 18, 1985, of JP 59-162294, Japan.

Patent Abstracts of Japan, vol. 12, No. 128 (C-489) (2975), Apr. 20, 1988, of JP 62-247097, Japan.

Patent Abstracts of Japan, vol. 6, No. 208 (C-130) (1086), Oct. 20, 1982, of JP 57-114695, Japan.

Patent Abstracts of Japan, vol. 009, No. 188, Aug. 3, 1985, of JP 60-056090 published Apr. 1, 1985.

Patent Abstracts of Japan, vol. 14, No. 390 (C-751) (4333), Aug. 23, 1990, of JP 2-145778 published Jun. 5, 1990.

May Hansen, Constitution of Binary Alloys, 1958, pp. 737-739.

*Primary Examiner*—John Niebling

*Assistant Examiner*—Kishor Mayekar

*Attorney, Agent, or Firm*—Frishauf, Holtz, Goodman & Woodward

[57] ABSTRACT

A method for manufacturing an iron-zinc alloy plated steel sheet having two plating layers and excellent in electropaintability and press-formability, which comprises the steps of: applying an alloying treatment under a temperature of from 420° to 520° C. to a zinc dip-plated steel sheet to form on the surface of the steel sheet an alloying-treated iron-zinc alloy dip-plating layer having on the surface thereof fine irregularities comprising numerous fine concavities and numerous fine convexities; then applying a temper rolling treatment at a reduction rate of from 0.3 to 1.5 to the alloying-treated steel sheet, to level the numerous fine convexities on the surface of the alloying-treated iron-zinc alloy dip-plating layer, so as to form on the surface of the steel sheet the alloying-treated iron-zinc alloy dip-plating layer as a lower layer having the numerous fine concavities on the surface thereof; and then applying an iron-zinc alloy electroplating treatment to the temper rolling treated steel sheet to form, on the alloying-treated iron-zinc alloy dip-plating layer as the lower layer, an iron-zinc alloy electroplating layer as an upper layer. The above-mentioned iron-zinc alloy electroplating treatment is carried out with an electric current density of from 50 to 150 A/dm$^2$ in an acidic electroplating bath containing iron ions and zinc ions, and having a pH value of from 1.0 to 4.0 and a temperature of from 40° to 70° C.

21 Claims, 2 Drawing Sheets

METHOD FOR MANUFACTURING IRON-ZINC ALLOY PLATED STEEL SHEET HAVING TWO PLATING LAYERS AND EXCELLENT IN ELECTROPAINTABILITY AND PRESSFORMABILITY

This application is a continuation-in-part application of application Ser. No. 07/764,010 filed Sep. 23, 1991 (now abandoned).

REFERENCE TO PATENTS, APPLICATIONS AND PUBLICATIONS PERTINENT TO THE INVENTION

As far as we know, there are available the following prior art documents pertinent to the present invention:

(1) Japanese Patent Publication No. 58-15,554 published on Mar. 26, 1983; and (2) Japanese Patent Provisional Publication No. 2-66,148 published on Mar. 6, 1990.

The contents of the prior art disclosed in the above-mentioned prior art documents will be discussed hereafter under the heading of "BACKGROUND OF THE INVENTION".

BACKGROUND OF THE INVENTION

1. Field of the Invention

The present invention relates to a method for manufacturing an iron-zinc alloy plated steel sheet having two plating layers and excellent in electropaintability and press-formability.

2. Related Art Statement

An iron-zinc alloy plated steel sheet has many advantages such as excellent corrosion resistance and electropaintability and a low manufacturing cost, so that the iron-zinc alloy plated steel sheet is widely used as a steel sheet for an automobile body. There is a strong demand for the improvement of electropaintability and press-formability of such an iron-zinc alloy plated steel sheet.

A paint film is formed on the surface of an iron-zinc alloy plated steel sheet usually as follows: Subjecting the iron-zinc alloy plated steel sheet to a phosphating treatment to form a phosphate film on the surface of the iron-zinc alloy plating layer, and then subjecting same to a cation-type electropainting treatment to form a paint film having a prescribed thickness on the phosphate film.

However, when forming the paint film on the phosphate film on the surface of the iron-zinc alloy plating layer by menas of the cation-type electropainting treatment, a hydrogen gas produced during the electropainting treatment and entangled into the paint film causes the production of crater-shaped pinholes in the paint film. The thus electropainted iron-zinc alloy plated steel sheet is further subjected to a finish painting to form a finished paint film on the above-mentioned paint film. The above-mentioned crater-shaped pinholes exert an adverse effect even on the finished paint film, thus deteriorating the quality of the painted iron-zinc alloy plated steel sheet.

As a method for manufacturing an iron-zinc alloy plated steel sheet solving the above-mentioned problem, Japanese Patent Publication No. 58-15,554 published on Mar. 26, 1983 discloses a method for manufacturing an iron-zinc alloy plated steel sheet for a cation-type electropainting, having two plating layers, which comprises the steps of:

forming an iron-zinc alloy plating layer as a lower layer on at least one surface of a steel sheet, the zinc content in said iron-zinc alloy plating layer as the lower layer being over 40 wt. % relative to said iron-zinc alloy plating layer as the lower layer; and forming an iron-zinc alloy plating layer as an upper layer on said iron-zinc alloy plating layer as the lower layer, the zinc content in said iron-zinc alloy plating layer as the upper layer being up to 40 wt. % relative to said iron-zinc alloy plating layer as the upper layer (hereinafter referred to as the "prior art 1").

The iron-zinc alloy plated steel sheet for an automobile body is subjected to a severe press-forming. The severe press-forming applied to the iron-zinc alloy plated steel sheet causes a powdery peeloff of the iron-zinc alloy plating layer, known as the "powdering" and a flaky peeloff of the iron-zinc alloy plating layer, known as the "flaking".

As a method for manufacturing an iron-zinc alloy plated steel sheet solving the above-mentioned problem, Japanese Patent Provisional Publication No. 2-66,148 published on Mar. 6, 1990 discloses a method for manufacturing an iron-zinc alloy plated steel sheet having two plating layers and excellent in powdering resistance and flaking resistance, which comprises the steps of:

forming an iron-zinc alloy plating layer as a lower layer on at least one surface of a steel sheet, the iron content in said iron-zinc alloy plating layer as the lower layer being up to 12 wt. % relative to said iron-zinc alloy plating layer as the lower layer; and forming an iron-zinc alloy plating layer as an upper layer on said iron-zinc alloy plating layer as the lower layer, the iron content in said iron-zinc alloy plating layer as the upper layer being at least 50 wt. % relative to said iron-zinc alloy plating layer as the upper layer, and the frictional coefficient of said iron-zinc alloy plating layer as the upper layer being up to 0.22 (hereinafter referred to as the "prior art 2").

According to the prior art 1, it is possible to prevent the production of the crater-shaped pinholes in the paint film, and according to the prior art 2, it is possible to prevent the occurrence of the powdering and the flaking of the iron-zinc alloy plating layer during the press-forming. In a method for manufacturing an iron-zinc alloy plated steel sheet having two plating layers such as that in the prior art 1 or 2, it is the usual practice to form a lower layer with an alloying-treated iron-zinc alloy dip-plating layer having a relatively large plating weight, and an upper layer with an iron-zinc alloy electroplating layer having a relatively small plating weight with a view to economically improve corrosion resistance.

The prior arts 1 and 2 have the following problems: Application of a severe press-forming to the iron-zinc alloy plated steel sheet manufactured in accordance with the method of the prior art 1 or 2 causes the production of cracks or peeloffs in the alloying-treated iron-zinc alloy dip-plating layer as the lower layer and the iron-zinc alloy electroplating layer as the upper layer.

When applying a phosphating treatment to the iron-zinc alloy plated steel sheet, in which the cracks or the peeloffs have thus been produced in the plating layers, to form a phosphate film on the surface of the iron-zinc alloy electroplating layer as the upper layer, the steel sheet exposed by the cracks or the peeloffs accelerates dissolution of the lower and the upper plating layers into the phosphating solution. As a result, phosphate crystal grains of the phosphate film grow in an abnormally large amount even on the inner surface of the crack or the peeloff of the plating layers.

When the paint film is baked after the electropainting, therefore, a large amount of crystal water is released from the phosphate crystal grains of the phosphate film. The crystal water thus released is entrapped in the paint film and vaporized to produce bubbles in the paint film. Production of the bubbles in the paint film is considered to be rather accelerated by the iron-zinc alloy electroplating layer as the upper layer. Production of these bubbles exerts an adverse effect even on the finished paint film, thus deteriorating the quality of the painted iron-zinc alloy plated steel sheet.

Under such circumstances, there is a demand for the development of a method for manufacturing an iron-zinc alloy plated steel sheet having two plating layers, in which such defects as bubbles and pinholes do not occur in the paint film even when subjected to a severe press-forming, and which is excellent in electropaintability and press-formability, but such a method has not as yet been proposed.

SUMMARY OF THE INVENTION

An object of the present invention is therefore to provide a method for manufacturing an iron-zinc alloy plated steel sheet having two plating layers, in which such defects as bubbles and pinholes do not occur in the paint film even when subjected to a severe press-forming, and which is excellent in electropaintability and press-formability.

In accordance with one of the features of the present invention, there is provided a method for manufacturing an iron-zinc alloy plated steel sheet having two plating layers and excellent in electropaintability and press-formability, which comprises the steps of:

passing a steel sheet through a zinc dip-plating bath having a temperature within a range of from 450° to 480° C. and having a chemical composition comprising:

aluminum: from 0.10 to 0.15 wt. %, and the balance being zinc and incidental impurities, to apply a zinc dip-plating treatment to said steel sheet, so as to form, on at least one surface of said steel sheet, a zinc dip-plating layer having a plating weight within a range of from 30 to 120 g/m$^2$ per surface of said steel sheet; then heating said steel sheet, on the surface of which said zinc dip-plating layer has thus been formed, to a temperature within a range of from 420° to 520° C. to apply an alloying treatment to the entirety of said zinc dip-plating layer and a surface portion of said steel sheet, so as to form, on said at least one surface of said steel sheet, an alloying-treated iron-zinc alloy dip-plating layer, said alloying-treated iron-zinc alloy dip-plating layer having on the surface thereof fine irregularities comprising numerous fine concavities and numerous fine convexities, and said alloying-treated iron-zinc alloy dip-plating layer having an iron content within a range of from 7 to 15 wt. % relative to said alloying-treated iron-zinc alloy dip-plating layer and having a plating weight within a range of from 30 to 120 g/m$^2$ per surface of said steel sheet; then applying a temper rolling treatment at a reduction rate within a range of from 0.3 to 1.5 to said steel sheet, on the surface of which said alloying-treated iron-zinc alloy dip-plating layer having said fine irregularities has thus been formed, to level said numerous fine convexities on the surface of said alloying-treated iron-zinc alloy dip-plating layer, so as to form, on said at least one surface of said steel sheet, an alloying-treated iron-zinc alloy dip-plating layer as a lower layer having said numerous fine concavities on the surface thereof; and then applying an iron-zinc alloy electroplating treatment to said steel sheet, on the surface of which said alloying-treated iron-zinc alloy dip-plating layer as the lower layer having said numerous fine concavities has thus been formed, with an electric current density within a range of from 50 to 150 A/dm$^2$ in an acidic electroplating bath having a pH value within a range of from 1.0 to 4.0 and a temperature within a range of from 40° to 70° C. and having a chemical composition comprising:

iron ions: from 0.50 to 1.75 mole/l, and zinc ions: from 0.05 to 0.35 mole/l, where, the ratio of the concentration of said iron ions to the concentration of said zinc ions being within a range of from 5 to 20, to form, on said alloying-treated iron-zinc alloy dip-plating layer as the lower layer, an iron-zinc alloy electroplating layer as an upper layer having a plating weight within a range of from 1 to 10 g/m$^2$ per surface of said steel sheet.

DETAILED DESCRIPTION OF PREFERRED EMBODIMENTS

Figure 1:
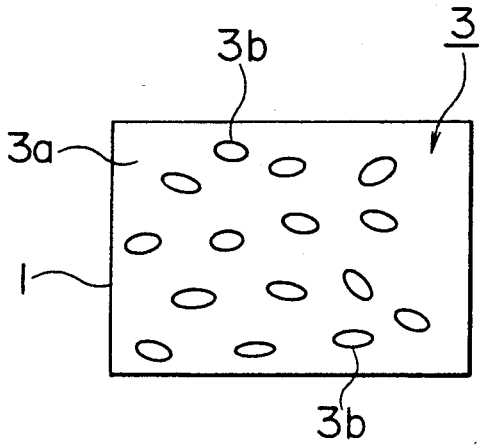
FIG. 1 is a diagrammatic plan view illustrating the iron-zinc alloy plated steel sheet manufactured in accordance with a first embodiment of the method of the present invention.

From the above-mentioned point of view, extensive studies were carried out to develop a method for manufacturing an iron-zinc alloy plated steel sheet having two plating layers, in which such defects as bubbles and pinholes do not occur in the paint film even when subjected to a severe press-forming, and which is excellent in electropaintability and press-formability.

When applying a severe press-forming to an iron-zinc alloy plated steel sheet having two plating layers, which comprises an alloying-treated iron-zinc alloy dip-plating layer as a lower layer formed on at least one surface of a steel sheet and an iron-zinc alloy electroplating layer as an upper layer formed on the iron-zinc alloy dip-plating layer as the lower layer, then subjecting same to a phosphating treatment to form a phosphate film on the surface of the iron-zinc alloy electroplating layer as the upper layer, and then subjecting same to an electropainting treatment to form a paint film on the phosphate film, bubbles are easily produced in the paint film. Causes of this phenomenon were first investigated. As a result, the following matters were made clear.

The iron-zinc alloy electroplating layer as the upper layer, which is formed through the electroprecipitation of metals, has a considerable inner stress therein. On the other hand, the alloying-treated iron-zinc alloy dip-plating layer as the lower layer has almost no inner stress therein. Consequently, the iron-zinc alloy electroplating layer as the upper layer locally and strongly restrains the alloying-treated iron-zinc alloy dip-plating layer as the lower layer. When applying a severe press-forming to the iron-zinc alloy plated steel sheet having these two plating layers, therefore, cracks or peeloffs tend to occur in the alloying-treated iron-zinc alloy dip-plating layer as the lower layer. As a result, bubbles are produced in the paint film resulting from the vaporization of crystal water released from the phosphate crystal grains of the phosphate film, as described above.

From these investigations, the following findings were obtained: By reducing the restraining force acting on the alloying-treated iron-zinc alloy dip-plating layer as the lower layer through dispersion of the inner stress in the iron-zinc alloy electroplating layer as the upper layer, the cracks or the peeloffs do not occur in the alloying-treated iron-zinc alloy dip-plating layer as the lower layer even when applying a severe press-forming to the iron-zinc alloy plated steel sheet having these two plating layers. As a result, bubbles are never produced in the paint film formed on the surface of the iron-zinc alloy electroplating layer as the upper layer.

The present invention was made on the basis of the above-mentioned findings. The iron-zinc alloy plated steel sheet of the present invention, having two plating layers and excellent in electropaintability and press-formability, which is manufactured in accordance with the method of the present inenvention, is described below with reference to the drawings and the method for manufacturing same is then described.

Figure 2:
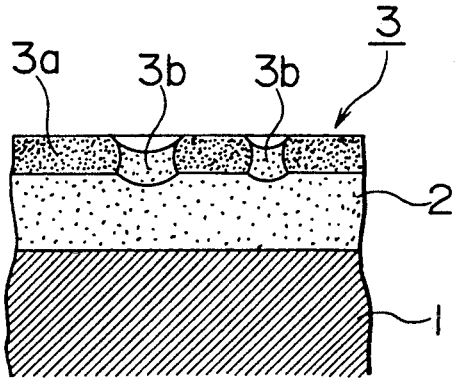
FIG. 2 is a diagrammatic vertical sectional view illustrating the iron-zinc alloy plated steel sheet manufactured in accordance with the first embodiment of the method of the present invention.

FIG. 1 is a diagrammatic plan view illustrating the iron-zinc alloy plated steel sheet manufactured in accordance with a first embodiment of the method of the present invention, and FIG. 2 is a diagrammatic vertical sectional view illustrating the iron-zinc alloy plated steel sheet manufactured in accordance with the first embodiment of the method of the present invention.

As shown in FIGS. 1 and 2, the iron-zinc alloy plated steel sheet manufactured in accordance with the first embodiment of the method of the present invention (hereinafter referred to as the "first iron-zinc alloy plated steel sheet") comprises a steel sheet 1, an alloying-treated iron-zinc alloy dip-plating layer 2 as a lower layer formed on at least one surface of the steel sheet 1, and an iron-zinc alloy electroplating layer 3 as an upper layer formed on the iron-zinc alloy dip-plating layer 2 as the lower layer. The iron-zinc alloy electroplating layer 3 as the upper layer comprises an iron-zinc alloy matrix 3*a* and a plurality of dots 3*b* of iron-zinc alloy formed in the iron-zinc alloy matrix 3*a*.

The iron content in the alloying-treated iron-zinc alloy dip-plating layer 2 as the lower layer should be limited within a range of from 7 to 15 wt. % relative to the iron-zinc alloy dip-plating layer 2. When the iron content in the iron-zinc alloy dip-plating layer 2 as the lower layer is under 7 wt. % relative to the iron-zinc alloy dip-plating layer 2, corrosion resistance of the iron-zinc alloy dip-plating layer 2 is degraded. When the iron content in the iron-zinc alloy dip-plating layer 2 as the lower layer is over 15 wt. % relative to the iron-zinc alloy dip-plating layer 2, on the other hand, press-formability of the iron-zinc alloy plated steel sheet is degraded.

The plating weight of the alloying-treated iron-zinc alloy dip-plating layer 2 as the lower layer should be limited within a range of from 30 to 120 $g/m^2$ per surface of the steel sheet 1. When the plating weight of the iron-zinc alloy dip-plating layer 2 as the lower layer is under 30 $g/m^2$ per surface of the steel sheet 1, corrosion resistance of the iron-zinc alloy dip-plating layer 2 is degraded. When the plating weight of the iron-zinc alloy dip-plating layer 2 as the lower layer is over 120 $g/m^2$ per surface of the steel sheet, on the other hand, press-formability of the iron-zinc alloy plated steel sheet is degraded.

The iron content in the iron-zinc alloy matrix 3*a* of the iron-zinc alloy electro-plating layer 3 as the upper layer should be limited within a range of from 60 to 90 wt. % relative to the iron-zinc alloy matrix 3*a*. The iron content in each of the plurality of dots 3*b* of iron-zinc alloy formed in the above-mentioned iron-zinc alloy matrix 3*a* should be limited within a range of from 30 to under 60 wt. % relative to each of the plurality of dots 3*b*.

The iron-zinc alloy electroplating layer 3 as the upper layer comprises the iron-zinc alloy matrix 3*a* and the plurality of dots 3*b* of iron-zinc alloy formed in the iron-zinc alloy matrix 3*a* as described above, and the former is different from the latter in the iron content. The structure of the iron-zinc alloy electroplating layer 3 as the upper layer is therefore non-uniform. Consequently, the inner stress in the iron-zinc alloy electroplating layer 3 as the upper layer is dispersed, and thus the restraining force acting on the alloying-treated iron-zinc alloy dip-plating layer 2 as the lower layer is reduced. Even when a severe press-forming is applied to the iron-zinc alloy plated steel sheet having these two plating layers, therefore, cracks or peeloffs never occur in the alloying-treated iron-zinc alloy dip-plating layer 2 as the lower layer. As a result, bubbles are never produced in the paint film formed on the surface of the iron-zinc alloy electroplating layer 3 as the upper layer.

When the iron content in the iron-zinc alloy matrix 3*a* of the iron-zinc alloy electroplating layer 3 as the upper layer is under 60 wt. % relative to the iron-zinc alloy matrix 3*a*, crater-shaped pinholes tend to occur in the paint film formed on the surface of the iron-zinc alloy electroplating layer 3. When the iron content in the iron-zinc alloy matrix 3*a* is over 90 wt. % relative to the iron-zinc alloy matrix 3*a*, on the other hand, corrosion resistance of the iron-zinc alloy electroplating layer 3 is degraded.

When the iron content in each of the plurality of dots 3*b* of iron-zinc alloy formed in the iron-zinc alloy matrix 3*a* of the iron-zinc alloy electroplating layer 3 as the upper layer is under 30 wt. % relative to each of the plurality of dots 3*b*, it is impossible to impart an excellent electropaintability to the iron-zinc alloy plated steel sheet. When the iron content in each of the above-described plurality of dots 3*b* is at least 60 wt. % relative to each of the plurality of dots 3*b*, on the other hand, the inner stress in the iron-zinc alloy electroplating layer 3 as the upper layer cannot be dispersed. It is therefore impossible to reduce the restraining force acting on the alloying-treated iron-zinc alloy dip-plating layer 2 as the lower layer, and thus to prevent the production of the cracks or the peeloffs in the iron-zinc alloy dip-plating layer 2 during the press-forming.

The total exposed area per unit area of the plurality of dots 3*b* of iron-zinc alloy formed in the iron-zinc alloy matrix 3*a* of the iron-zinc alloy electroplating layer 3 as the upper layer should be limited within a range of from 5 to 50% of the unit area of the iron-zinc alloy electroplating layer 3. When the total exposed area of the plurality of dots 3*b* is under 5% of the unit area of the iron-zinc alloy electroplating layer 3, the inner stress in the iron-zinc alloy electroplating layer 3 cannot be fully dispersed. It is therefore impossible to reduce the restraining force acting on the alloying-treated iron-zinc alloy dip-plating layer 2 as the lower layer, and thus to prevent the production of the cracks or the peeloffs in the iron-zinc alloy dip-plating layer 2 during the press-forming. When the total exposed area of the plurality of dots 3*b* is over 50% of the unit area of the iron-zinc alloy electroplating layer 3 as the upper layer, on the other hand, crater-shaped pinholes tend to occur in the paint film formed on the surface of the iron-zinc alloy electroplating layer 3.

The diameter of each of the plurality of dots 3*b* of iron-zinc alloy formed in the iron-zinc alloy matrix 3*a* of the iron-zinc alloy electroplating layer 3 as the upper layer should be limited within a range of from 5 to 100 μm. When the diameter of each of the plurality of dots 3*b* is under 5 μm, the inner stress in the iron-zinc alloy electroplating layer 3 cannot be fully dispersed. It is therefore impossible to reduce the restraining force acting on the alloying-treated iron-zinc alloy dip-plating layer 2 as the lower layer, and thus to prevent the production of the cracks or the peeloffs in the iron-zinc alloy dip-plating layer 2 during the press-forming. When the diameter of each of the plurality of dots 3*b* is over 100 μm, on the other hand, crater-shaped pinholes tend to occur in the paint film formed on the surface of the iron-zinc alloy electroplating layer 3. The diameter of each of the plurality of dots 3*b* is more preferably limited within a range of from 10 to 70 μm.

The plating weight of the iron-zinc alloy electroplating layer as the upper layer 3, i.e., the total plating weight of the iron-zinc alloy matrix 3*a* and the plurality of dots 3*b* of iron-zinc alloy should be limited within a range of from 1 to 10 g/m$^2$ per surface of the steel sheet 1. With a total plating weight of under 1 g/m$^2$ per surface of the steel sheet 1, crater-shaped pinholes tend to occur in the paint film formed on the surface of the iron-zinc alloy electroplating layer 3 as the upper layer. With a total plating weight of over 10 g/m$^2$ per surface of the steel sheet 1, on the other hand, press-formability of the iron-zinc alloy plated steel sheet is degraded. The plating weight of the iron-zinc alloy electroplating layer as the upper layer is more preferably limited within a range of from 1.5 to 5.0 g/m$^2$.

Figure 3:
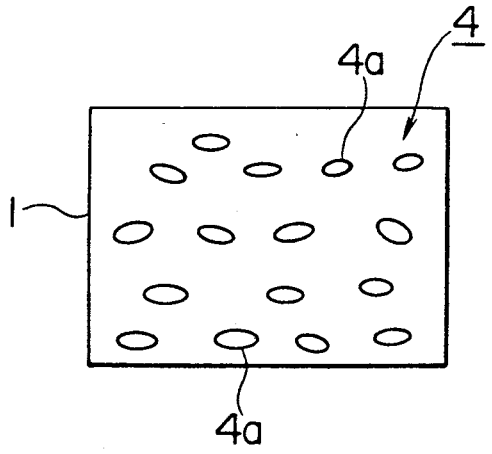
FIG. 3 is a diagrammatic plan view illustrating the iron-zinc alloy plated steel sheet manufactured in accordance with a second embodiment of the method of the present invention.
Figure 4:
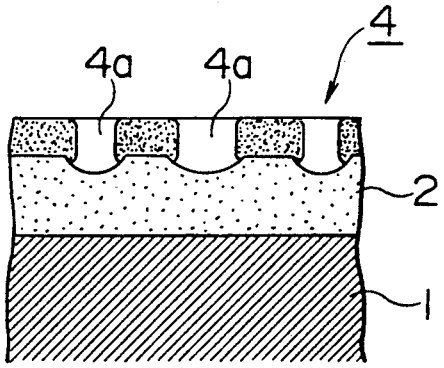
FIG. 4 is a diagrammatic vertical sectional view illustrating the iron-zinc alloy plated steel sheet manufactured in accordance with the second embodiment of the method of the present invention.

FIG. 3 is a diagrammatic plan view illustrating the iron-zinc alloy plated steel sheet manufactured in accordance with a second embodiment of the method of the present invention, and FIG. 4 is a diagrammatic vertical sectional view illustrating the iron-zinc alloy plated steel sheet manufactured in accordance with the second embodiment of the method of the present invention.

As shown in FIGS. 3 and 4, the iron-zinc alloy plated steel sheet manufactured in accordance with the second embodiment of the method of the present invention (hereinafter referred to as the "second iron-zinc alloy plated steel sheet") comprises a steel sheet 1, an alloying-treated iron-zinc alloy dip-plating layer 2 as a lower layer formed on at least one surface of the steel sheet 1, and an iron-zinc alloy electroplating layer 4 as an upper layer formed on the iron-zinc alloy dip-plating layer 2 as the lower layer, and the iron-zinc alloy electroplating layer 4 as the upper layer has a plurality of pores 4*a*.

The iron content in the alloying-treated iron-zinc alloy dip-plating layer 2 as the lower layer should be limited within a range of from 7 to 15 wt. % relative to the iron-zinc alloy dip-plating layer 2, and the plating weight of the alloying-treated iron-zinc alloy dip-plating layer 2 as the lower layer should be limited within a range of from 30 to 120 g/m$^2$, under the same reasons just as those in the first iron-zinc alloy plated steel sheet.

The iron content in the iron-zinc alloy electroplating layer 4 as the upper layer should be limited within a range of from 60 to 90 wt. % relative to the iron-zinc alloy electroplating layer 4. The iron-zinc alloy electroplating layer 4 as the upper layer has the plurality of pores 4*a* as described above. The structure of the iron-zinc alloy electroplating layer 4 as the upper layer is therefore non-uniform. Consequently, the inner stress in the iron-zinc alloy electroplating layer 4 as the upper layer is dispersed, and thus the restraining force acting on the alloying-treated iron-zinc alloy dip-plating layer 2 as the lower layer is reduced. Even when a severe press-forming is applied to the iron-zinc alloy plated steel sheet having these two plating layers, therefore, cracks or peeloffs never occur in the alloying-treated iron-zinc alloy dip-plating layer 2 as the lower layer. As a result, bubbles are never produced in the paint film formed on the surface of the iron-zinc alloy electroplating layer 4 as the upper layer.

When the iron content in the iron-zinc alloy electroplating layer 4 as the upper layer is under 60 wt. % relative to the iron-zinc alloy electroplating layer 4, crater-shaped pinholes tend to occur in the paint film formed on the surface of the iron-zinc alloy electroplating layer 4. When the iron content in the iron-zinc alloy electroplating layer 4 as the upper layer is over 90 wt. % relative to the iron-zinc alloy electroplating layer 4, on the other hand, corrosion resistance of the iron-zinc alloy electroplating layer 4 as the upper layer is degraded.

The total opening area per unit area of the plurality of pores 4*a* present in the iron-zinc alloy electroplating layer 4 as the upper layer should be limited within a range of from 5 to 50% of the unit area of the iron-zinc alloy electroplating layer 4. When the total opening area of the plurality of pores 4*a* is under 5% of the unit area of the iron-zinc alloy electroplating layer 4, the inner stress in the iron-zinc alloy electroplating layer 4 cannot be fully dispersed. It is therefore impossible to reduce the restraining force acting on the alloying-treated iron-zinc alloy dip-plating layer 2 as the lower layer, and thus to prevent the production of the cracks or the peeloffs in the iron-zinc alloy dip-plating layer 2 during the press-forming. When the total opening area of the plurality of pores 4*a* is over 50% of the unit area of the iron-zinc alloy electroplating layer 4, on the other hand, crater-shaped pinholes tend to occur in the paint film formed on the surface of the iron-zinc alloy electroplating layer 4.

The diameter of each of the plurality of pores 4*a* present in the iron-zinc alloy electroplating layer 4 as the upper layer should be limited within a range of from 5 to 100 μm. When the diameter of each of the plurality of pores 4*a* is under 5 m, the inner stress in the iron-zinc alloy electroplating layer 4 cannot be fully dispersed. It is therefore impossible to reduce the restraining force acting on the alloying-treated iron-zinc alloy dip-plating layer 2 as the lower layer, and thus to prevent the production of the cracks or the peeloffs in the iron-zinc alloy dip-plating layer 2 during the press-forming. When the diameter of each of the plurality of pores 4a is over 100 μm, on the other hand, crater-shaped pinholes tend to occur in the paint film formed on the surface of the iron-zinc alloy electroplating layer 4. The diameter of each of the plurality of pores 4a is more preferably limited within a range of from 10 to 70 μm.

The plating weight of the iron-zinc alloy electroplating layer 4 as the upper layer should be limited within a range of from 1 to 10 g/m$^2$ per surface of the steel sheet 1. When the plating weight of the iron-zinc alloy electroplating layer 4 is under 1 g/m$^2$ per surface of the steel sheet 1, crater-shaped pinholes tend to occur in the paint film formed on the surface of the iron-zinc alloy electroplating layer 4 as the upper layer. When the plating weight of the iron-zinc alloy electroplating layer 4 is over 10 g/m$^2$ per surface of the steel sheet 1, on the other hand, press-formability of the iron-zinc alloy plated steel sheet is degraded. The plating weight of the iron-zinc alloy electroplating layer 4 is more preferably limited within a range of from 1.5 to 5.0 g/m$^2$.

Now, the method of the present invention for manufacturing the iron-zinc alloy plated steel sheet having two plating layers is described hereafter.

The first embodiment of the method of the present invention for manufacturing the first iron-zinc alloy plated steel sheet comprises the steps of:

passing a steel sheet 1 through a zinc dip-plating bath having a temperature within a range of from 450° to 480° C. and having a prescribed chemical composition, to apply a zinc dip-plating treatment to the steel sheet 1, so as to form, on at least one surface of the steel sheet 1, a zinc dip-plating layer having a plating weight within a range of from 30 to 120 g/m$^2$ per surface of the steel sheet 1; then heating the steel sheet 1, on the surface of which the zinc dip-plating layer has thus been formed, to a temperature d within a range of from 420° to 520° C. to apply an alloying treatment to the entirety of the zinc dip-plating layer and a surface portion of the steel sheet 1, so as to form, on the at least one surface of the steel sheet 1, an alloying-treated iron-zinc alloy dip-plating layer, the alloying-treated iron-zinc alloy dip-plating layer having on the surface thereof fine irregularities comprising numerous fine concavities and numerous fine convexities, and the alloying-treated iron-zinc alloy dip-plating layer having an iron content within a range of from 7 to 15 wt. % relative to the alloying-treated iron-zinc alloy dip-plating layer and having a plating weight within a range of from 30 to 120 g/m$^2$ per surface of the steel sheet 1; then applying a temper rolling treatment at a reduction rate within a range of from 0.3 to 1.5 to the steel sheet 1, on the surface of which the alloying-treated iron-zinc alloy dip-plating layer having the fine irregularities has thus been formed, to level the numerous fine convexities on the surface of the alloying-treated iron-zinc alloy dip-plating layer, so as to form, on the at least one surface of the steel sheet 1, an alloying-treated iron-zinc alloy dip-plating layer 2 as a lower layer having the numerous fine concavities on the surface thereof; and then applying an iron-zinc alloy electroplating treatment to the steel sheet 1, on the surface of which the alloying-treated iron-zinc alloy dip-plating layer 2 as the lower layer having the numerous fine concavities has thus been formed, with an electric current density within a range of from 50 to under 100 A/dm$^2$ in an acidic electroplating bath having a pH value within a range of from 1.0 to 4.0 and a temperature within a range of from 40° to 70° C. and having a prescribed chemical composition, to form, on the alloying-treated iron-zinc alloy dip-plating layer 2 as the lower layer, an iron-zinc alloy electroplating layer 3 as an upper layer which comprises an iron-zinc alloy matrix 3a and a plurality of dots 3b of iron-zinc alloy formed in the iron-zinc alloy matrix 3a, and has a plating weight within a range of from 1 to 10 g/m$^2$ per surface of the steel sheet 1.

When the temperature of the zinc dip-plating bath used in the zinc dip-plating treatment is under 450° C., wettability of the zinc dip-plating bath to the steel sheet is deteriorated due to the decrease in viscosity of the zinc dip-plating bath, and consequently, smoothness of the surface of the zinc dip-plating layer formed by means of the zinc dip-plating treatment is degraded, and in addition, the entire surface of the steel sheet 1 can not be covered with the zinc dip-plating layer, thus causing the surface of the steel sheet 1 to be partially exposed. When the temperature of the dip-plating bath is over 480° C., on the other hand, an amount of dross produced in the zinc dip-plating bath is increased, and the dross thus produced in a large amount causes defects on the surface of the zinc dip-plating layer formed by means of the zinc dip-plating treatment. The temperature of the dip-plating bath used in the zinc dip-plating treatment should therefore be limited within a range of from 450° to 480° C.

Aluminum is added to the zinc dip-plating bath used in the zinc dip-plating treatment in order to inhibit an excessive alloying of the zinc dip-plating layer and the surface portion of the steel sheet 1 in the alloying treatment. With an aluminum content in the zinc dip-plating bath of under 0.10 wt. %, the above-described effect of inhibiting an excessive alloying by means of aluminum is not fully attained, thus causing the increase in the iron content in the alloying-treated iron-zinc alloy dip-plating layer formed by means of the alloying treatment to over 15 wt. % outside the scope of the present invention. With an aluminum content in the zinc dip-plating bath of over 0.15, the above-described effect of inhibiting an excessive alloying by means of aluminum is unnecessarily attained, on the other hand, thus causing the remaining of unalloyed portions in the alloying-treated iron-zinc alloy dip-plating layer formed by means of the alloying treatment. The aluminum content in the zinc dip-plating bath used in the zinc dip-plating treatment should therefore be limited within a range of from 0.10 to 0.15 wt. %. The aluminum content in the zinc dip-plating bath used in the zinc dip-plating treatment is more preferably limited within a range of from 0.12 to 0.14 wt. %.

The heating in the alloying treatment is carried out at a temperature within a range of from 420° to 520° C., which is lower than the usual heating temperature for the alloying treatment. As a result, columnar crystal grains (ζ-phase) are produced in the alloying-treated iron-zinc alloy dip-plating layer, so that fine irregularities comprising numerous fine concavities and numerous fine convexities are formed on the surface of the iron-zinc alloy dip-plating layer. When the heating temperature in the alloying treatment is under 420° C. or over 520° C., the above-described columnar crystal grains (ζ-phase) can not be produced.

When the reduction rate in the temper rolling treatment is under 0.3%, it is impossible to completely level the numerous fine convexities, during the alloying treatment, on the surface of the iron-zinc alloy dip-plating layer, and consequently, the iron-zinc alloy electroplating layer 3 as the upper layer comprising the iron-zinc alloy matrix 3*a* and the plurality of dots 3*b* of iron-zinc alloy formed in the iron-zinc matrix cannot be formed, during the iron-zinc alloy electroplating treatment, on the alloying-treated iron-zinc alloy dip-plating layer 2 as the lower layer which has been formed in the temper rolling treatment. When the reduction rate in the temper rolling treatment is over 1.5%, on the other hand, the entire surface of the alloying-treated iron-zinc alloy dip-plating layer 2 as the lower layer is substantially completely leveled so that there disappear not only the numerous fine convexities but also the numerous fine concavities, which have been formed, during the alloying treatment, on the surface of the iron-zinc alloy dip-plating layer, with a result that the iron-zinc alloy electroplating layer 3 as the upper layer comprising the iron-zinc alloy matrix 3*a* and the plurality of dots 3*b* of iron-zinc alloy formed in the iron-zinc alloy matrix 3*a* cannot be formed, during the iron-zinc alloy electroplating treatment, on the alloying-treated iron-zinc alloy dip-plating layer 2 as the lower layer having numerous concavities, which has been formed in the temper rolling treatment. The reduction rate in the temper rolling treatment should therefore be limited within a range of from 0.3 to 1.5. The above-described reduction rate is more preferably limited within a range of from 0.4 to 1.2.

The acidic electroplating bath in the iron-zinc alloy electroplating treatment has a chemical composition comprising:

iron ions: from 0.50 to 1.75 mole/l, and zinc ions: from 0.05 to 0.35 mole/l, where, the ratio of the concentration of the iron ions to the concentration of the zinc ions being within a range of from 5 to 20.

The amount of iron ions in the acidic electroplating bath used in the iron-zinc alloy electroplating treatment affects the iron content in the iron-zinc alloy matrix 3*a* of the iron-zinc alloy electroplating layer 3 as the upper layer formed by means of the iron-zinc alloy electroplating treatment, on the one hand, and the surface quality of the iron-zinc alloy electroplating layer 3 as the upper layer, on the other hand. With an amount of iron ions in the acidic electroplating bath of under 0.50 mole/l , the iron content in the above-described iron-zinc alloy matrix 3*a* cannot be maintained stably within a range of from 60 to 90 wt. %. With an amount of iron ions in the acidic electroplating bath of over 1.75 mole/l , on the other hand, an amount of trivalent iron ions produced in the acidic electroplating bath is increased to easily produce sludge which adheres on the surface of the iron-zinc alloy electroplating layer 3 as the upper layer to degrade the surface quality thereof. The amount of iron ions in the acidic electroplating bath used in the iron-zinc alloy electroplating treatment should therefore be limited within a range of from 0.50 to 1.75 mole/l.

The amount of zinc ions in the acidic electroplating bath used in the iron-zinc alloy electroplating treatment affects the surface quality and corrosion resistance of the iron-zinc alloy electroplating layer 3 as the upper layer formed by means of the iron-zinc alloy electroplating treatment, on the one hand, and the iron content in the iron-zinc alloy matrix 3*a* of the iron-zinc alloy electroplating layer 3 as the upper layer, on the other hand. With an amount of zinc ions in the acidic electroplating bath of under 0.05 mole/l, a defect such as a burnt deposit may easily be produced in the iron-zinc alloy electroplating layer 3 as the upper layer, and moreover, the iron content in the iron-zinc alloy matrix 3*a* of the iron-zinc alloy electroplating layer 3 as the upper layer exceeds 90 wt. %, with a result that corrosion resistance of the above-described iron-zinc alloy matrix 3*a* is degraded. With an amount of zinc ions in the acidic electroplating bath of over 0.35 mole/l, on the other hand, the iron content in the above-described iron-zinc alloy matrix 3*a* cannot be maintained stably within a range of from 60 to 90 wt. %. The amount of zinc ions in the acidic electroplating bath used in the iron-zinc alloy electroplating treatment should therefore be limited within a range of from 0.05 to 0.35 mole/l.

The ratio of the concentration of iron ions to the concentration of zinc ions in the acidic electroplating bath used in the iron-zinc alloy electroplating treatment affects the iron content in the iron-zinc alloy matrix 3*a* of the iron-zinc alloy electroplating layer 3 as the upper layer. With a ratio of the concentration of iron ions to the concentration of zinc ions in the acidic electroplating bath of under 5, the iron content in the above-described iron-zinc alloy matrix 3*a* cannot be maintained stably within a range of from 60 to 90 wt. %. With a ratio of the concentration of iron ions to the concentration of zinc ions in the acidic electroplating bath of over 20, on the other hand, the iron content in the above-described iron-zinc alloy matrix 3*a* exceeds 90 wt. %, with a result that corrosion resistance of the iron-zinc alloy matrix 3*a* is degraded. The ratio of the concentration of iron ions to the concentration of zinc ions in the acidic electroplating bath should therefore be limited within a range of from 5 to 20.

The pH value of the acidic electroplating bath used in the iron-zinc alloy electroplating treatment affects the stability of the acidic electroplating bath and the electroplating efficiency. With a pH value of the acidic electroplating bath of under 1.0, the electroplating efficiency is deteriorated. With a pH value of the acidic electroplating bath of over 4.0, on the other hand, an amount of trivalent iron ions produced in the acidic electroplating bath is increased to easily produce sludge which adheres on the surface of the iron-zinc alloy electroplating layer 3 as the upper layer to degrade the surface quality thereof. The pH value of the acidic electroplating bath should therefore be limited within a range of from 1.0 to 4.0. The pH value of the acidic electroplating bath is more preferably limited within a range of from 1.5 to 2.5.

The temperature of the acidic electroplating bath used in the iron-zinc alloy electroplating treatment affects the surface quality of the iron-zinc alloy electroplating layer 3 as the upper layer formed by means of the iron-zinc alloy electroplating treatment. With a temperature of the acidic electroplating bath of under 40° C., a defect such as a burnt deposit may easily be produced in the iron-zinc alloy electroplating layer 3 as the upper layer. With a temperature of the acidic electroplating bath of over 70° C., on the other hand, an amount of trivalent iron ions produced in the acidic electroplating bath is increased to easily produce sludge which adheres on the surface of the iron-zinc alloy electroplating layer 3 as the upper layer to degrade the surface quality thereof. The temperature of the acidic electroplating bath should therefore be limited within a range of from 40° to 70° C.

The electric current density in the iron-zinc alloy electroplating treatment affects the formation of the plurality of dots 3b of iron-zinc alloy in the iron-zinc alloy matrix 3a of the iron-zinc alloy electroplating layer 3 as the upper layer. With an electric current density of under 50 A/dm$^2$, iron-zinc alloy having substantially the uniform iron content deposits not only on the flat portions of the surface of the alloying-treated iron-zinc alloy dip-plating layer 2 as the upper layer, which have been formed by means of the temper rolling treatment, but also on the numerous fine concavities on the surface of the alloying-treated iron-zinc alloy dip-plating layer 2 as the lower layer, with a result that the iron-zinc alloy electroplating layer 3 as the upper layer comprising the iron-zinc alloy matrix 3a and the plurality of dots 3b of iron-zinc alloy formed in the iron-zinc alloy matrix 3a cannot be formed on the alloying-treated iron-zinc alloy dip-plating layer 2 as the lower layer. With an electric current density of at least 100 A/dm$^2$, on the other hand, iron-zinc alloy is not substantially deposited at a portion of the iron-zinc alloy matrix 3a, which portion corresponds to each of the numerous fine concavities on the surface of the alloying-treated iron-zinc alloy dip-plating layer 2 as the lower layer, with a result that the iron-zinc alloy electroplating layer 3 as the upper layer comprising the iron-zinc alloy matrix 3a and the plurality of dots 3b of iron-zinc alloy formed in the iron-zinc alloy matrix 3a cannot be formed on the alloying-treated iron-zinc alloy dip-plating layer 2 as the lower layer. The electric current density should therefore be limited within a range of from 50 to under 100 A/dm$^2$.

The iron-zinc alloy electroplating layer 3 as the upper layer comprising the iron-zinc alloy matrix 3a and the plurality of dots 3b of iron-zinc alloy formed in the iron-zinc alloy matrix 3a, can be formed on the alloying-treated iron-zinc alloy dip-plating layer 2 as the lower layer by applying the iron-zinc alloy electroplating treatment with an electric current density within a range of from 50 to under 100 A/dm$^2$. The above-mentioned formation of the iron-zinc alloy electroplating layer 3 is based on the fact that, upon applying the iron-zinc alloy electroplating treatment to the steel sheet 1 on the surface of which the alloying-treated iron-zinc alloy dip-plating layer 2 as the lower layer having the numerous fine concavities has been formed, it is more difficult for the plating electric current to flow through the numerous fine concavities on the surface of the alloying-treated iron-zinc alloy dip-plating layer 2 than through the flat portions thereof.

The second embodiment of the method of the present invention for manufacturing the second iron-zinc alloy plated steel sheet comprises the steps of:

passing a steel sheet 1 through a zinc dip-plating bath having a temperature within a range of from 450° to 480° C. and having a prescribed chemical composition, to apply a zinc dip-plating treatment to the steel sheet 1, so as to form, on at least one surface of the steel sheet 1, a zinc dip-plating layer having a plating weight within a range of from 30 to 120 g/m$^2$ per surface of the steel sheet 1; then heating the steel sheet 1, on the surface of which the zinc dip-plating layer has thus been formed, to a temperature within a range of from 420° to 520° C. to apply an alloying treatment to the entirety of the zinc dip-plating layer and a surface portion of the steel sheet 1, so as to form, on the at least one surface of the steel sheet 1, an alloying-treated iron-zinc alloy dip-plating layer, the alloying-treated iron-zinc alloy dip-plating layer having on the surface thereof fine irregularities comprising numerous fine concavities and numerous fine convexities, and the alloying-treated iron-zinc alloy dip-plating layer having an iron content within a range of from 7 to 15 wt. % relative to the alloy-treated iron-zinc alloy dip-plating layer and having a plating weight within a range of from 30 to 120 g/m$^2$ per surface of the steel sheet 1; then applying a temper rolling treatment at a reduction rate within a range of from 0.3 to 1.5 to the steel sheet 1, on the surface of which the alloying-treated iron-zinc alloy dip-plating layer having the fine irregularities has thus been formed, to level the numerous fine convexities on the surface of the alloying-treated iron-zinc alloy dip-plating layer, so as to form, on the at least one surface of the steel sheet 1, an alloying-treated iron-zinc alloy dip-plating layer 2 as a lower layer having the numerous fine concavities on the surface thereof; and then applying an iron-zinc alloy electroplating treatment to the steel sheet 1, on the surface of which the alloying-treated iron-zinc alloy dip-plating layer 2 as the lower layer having the numerous fine concavities has thus been formed, with an electric current density within a range of from 100 to 150 A/dm$^2$ in an acidic electroplating bath having a pH value within a range of from 1.0 to 4.0 and a temperature within a range of from 40° to 70° C. and having a prescribed chemical composition, to form, on the alloying-treated iron-zinc alloy dip-plating layer 2 as the lower layer, an iron-zinc alloy electroplating layer 4 as an upper layer which has a plurality of pores 4a, and has an iron content within a range of from 60 to 90 wt. % and a plating weight within a range of from 1 to 10 g/m$^2$ per surface of the steel sheet 1.

The zinc dip-plating treatment, the alloying treatment and the temper rolling treatment in the second embodiment of the method of the present invention are respectively identical to those in the above-described first embodiment of the method of the present invention. The explanations of these treatments are therefore omitted.

The electric current density in the iron-zinc alloy electroplating treatment in the first embodiment of the method of the present invention is limited within a range of from 50 to under 100 A/dm$^2$ as described above, whereas the electric current density in the iron-zinc alloy electroplating treatment in the second embodiment of the method of the present invention is limited within a range of from 100 to 150 A/dm$^2$. With an electric current density of over 150 A/dm$^2$, burnt deposit is produced on the iron-zinc alloy electroplating layer 4 as the upper layer. The chemical composition, the pH value and the temperature of the acidic electroplating bath in the iron-zinc alloy electroplating treatment in the second embodiment of the method of the present invention are respectively identical to those in the iron-zinc alloy electroplating treatment in the first embodiment of the method of the present invention. The explanations of them are therefore omitted.

Upon applying the iron-zinc alloy electroplating treatment to the steel sheet 1 on the surface of which the alloying-treated iron-zinc alloy dip-plating layer 2 as the lower layer having the numerous fine concavities has been formed, it is more difficult for the plating electric current to flow through the numerous fine concavities on the surface of the alloying-treated iron-zinc alloy dip-plating layer 2 than through the flat portions thereof. By applying the iron-zinc alloy electroplating treatment with an electric current (density within a range of from 100 to 150 A/dm$^2$, iron-zinc alloy deposits only on the flat portions on the surface of the alloying-treated iron-zinc alloy dip-plating layer 2 as the lower layer, whereas iron-zinc alloy does not substantially deposit at a portion of the iron-zinc electroplating layer 4 as the upper layer, which portion corresponds to each of the numerous fine concavities. It is therefore possible to form, on the alloying-treated iron-zinc alloy dip-plating layer 2 as the lower layer, the iron-zinc alloy electroplating layer 4 as the upper layer having the plurality of pores 4*a*.

Now, the method of the present invention for manufacturing the iron-zinc alloy plated steel sheet having two plating layers and excellent in electropaintability and press-formability, is described below further in detail by means of examples while comparing with examples for comparison.

EXAMPLES

The both surfaces of each of cold-rolled steel sheets 1 having a thickness of 0.8 mm were cleaned by means of a usual alkali degreasing and a usual electrolytic pickling. Then, each of the thus cleaned cold-rolled steel sheets 1 was subjected to a zinc dip-plating treatment under any one of eight kinds of zinc dip-plating conditions A to H as shown in Table 1 to form a zinc dip-plating layer on each of the both surfaces of the cold-rolled steel sheet 1. Then, the cold-rolled steel sheet 1, on the surface of which the zinc dip-plating layer has thus been formed, was heated to an alloying treatment temperature as shown in Table 1, to apply an alloying treatment to the entirety of the zinc dip-plating layer and a surface portion of the cold-rolled steel sheet 1, so as to form, on the both surfaces of the cold-rolled steel sheet 1, an alloying-treated iron-zinc alloy dip-plating layer having on the surface thereof fine irregularities comprising numerous fine concavities and numerous fine convexities.

TABLE 1

| Kind | Chemical composition of Zn dip-plating bath (wt. %) Al | Zn and incidental impurities | Temperature of Zn dip-plating bath (°C.) | Temperature of steel sheet passing through Zn dip-plating bath (°C.) | Alloying treatment temperature (°C.) | Alloying treatment time |
|---|---|---|---|---|---|---|
| A | 0.12 | Balance | 460 | 462 | 490 | Adjusting so that alloying-treated Fe—Zn alloy dip-plating layer has prescribed iron content |
| B | 0.14 | Balance | 460 | 470 | 510 | |
| C | 0.12 | Balance | 460 | 462 | 520 | |
| D | 0.10 | Balance | 470 | 472 | 480 | |
| E | 0.15 | Balance | 470 | 472 | 490 | |
| F | 0.13 | Balance | 450 | 462 | 490 | |
| G | 0.13 | Balance | 480 | 481 | 500 | |
| H | 0.13 | Balance | 460 | 465 | 420 | |
| I | 0.09 | Balance | 460 | 462 | 450 | |
| J | 0.16 | Balance | 460 | 462 | 520 | |
| K | 0.12 | Balance | 445 | 450 | 490 | |
| L | 0.12 | Balance | 485 | 490 | 490 | |
| M | 0.13 | Balance | 460 | 462 | 415 | |
| N | 0.13 | Balance | 460 | 462 | 525 | |

TABLE 2

| Kind | Chemical composition of electroplating bath (g/l) $FeSO_4.7H_2O$ | $ZnSO_4.7H_2O$ | Fe ion concentration in electroplating bath (mole/l) | Zn ion concentration in electroplating bath (mole/l) | Ratio of Fe ion concetration to Zn ion concentration | pH value of electroplating bath | Electro-Plating bath temperature (°C.) | Plating electric current density (A/dm$^2$) |
|---|---|---|---|---|---|---|---|---|
| (1) | 380 | 20 | 1.37 | 0.07 | 19.6 | 1.8 | 50 | 70 |
| (2) | 380 | 20 | 1.37 | 0.07 | 19.6 | 1.8 | 50 | 120 |
| (3) | 340 | 60 | 1.22 | 0.21 | 5.8 | 1.8 | 50 | 70 |
| (4) | 340 | 60 | 1.22 | 0.21 | 5.8 | 1.8 | 50 | 120 |
| (5) | 140 | 15 | 0.50 | 0.05 | 10.0 | 2.0 | 50 | 60 |
| (6) | 470 | 60 | 1.70 | 0.21 | 8.1 | 1.5 | 60 | 140 |
| (7) | 220 | 15 | 0.79 | 0.05 | 15.8 | 1.5 | 50 | 70 |
| (8) | 140 | 30 | 0.50 | 0.10 | 5.0 | 2.5 | 50 | 70 |
| (9) | 390 | 20 | 1.40 | 0.07 | 20.0 | 2.5 | 50 | 70 |
| (10) | 380 | 20 | 1.37 | 0.07 | 19.6 | 1.0 | 50 | 60 |
| (11) | 380 | 20 | 1.37 | 0.07 | 19.6 | 4.0 | 50 | 60 |
| (12) | 380 | 20 | 1.37 | 0.07 | 19.6 | 1.8 | 40 | 130 |
| (13) | 380 | 20 | 1.37 | 0.07 | 19.6 | 1.8 | 70 | 130 |
| (14) | 340 | 60 | 1.22 | 0.21 | 5.8 | 2.0 | 50 | 50 |
| (15) | 340 | 60 | 1.22 | 0.21 | 5.8 | 2.0 | 50 | 98 |
| (16) | 340 | 60 | 1.22 | 0.21 | 5.8 | 2.0 | 50 | 100 |
| (17) | 340 | 60 | 1.22 | 0.21 | 5.8 | 2.0 | 50 | 150 |
| (18) | 485 | 100 | 1.75 | 0.35 | 5.0 | 2.0 | 50 | 70 |
| (19) | 470 | 60 | 1.70 | 0.21 | 8.1 | 2.0 | 50 | 70 |
| (20) | 140 | 30 | 0.50 | 0.10 | 5.0 | 2.0 | 50 | 100 |
| (21) | 220 | 15 | 0.79 | 0.05 | 15.8 | 2.0 | 50 | 100 |
| (22) | 485 | 100 | 1.75 | 0.35 | 5.0 | 2.0 | 50 | 150 |
| (23) | 295 | 60 | 1.05 | 0.21 | 5.0 | 2.0 | 50 | 130 |
| (24) | 390 | 20 | 1.40 | 0.07 | 20.0 | 2.0 | 50 | 130 |

TABLE 2-continued

| Kind | Chemical composition of electroplating bath (g/l) $FeSO_4.7H_2O$ | $ZnSO_4.7H_2O$ | Fe ion concentration in electro-plating bath (mole/l) | Zn ion concentration in electro-plating bath (mole/l) | Ratio of Fe ion concetration to Zn ion concentration | pH value of electro-plating bath | Electro-Plating bath temperature (°C.) | Plating electric current density ($A/dm^2$) |
|---|---|---|---|---|---|---|---|---|
| (25) | 380 | 20 | 1.37 | 0.07 | 19.6 | 1.0 | 50 | 130 |
| (26) | 380 | 20 | 1.37 | 0.07 | 19.6 | 4.0 | 50 | 130 |
| (27) | 380 | 20 | 1.37 | 0.07 | 19.6 | 2.0 | 40 | 70 |
| (28) | 380 | 20 | 1.37 | 0.07 | 19.6 | 2.0 | 70 | 70 |
| (29) | 135 | 15 | 0.49 | 0.05 | 9.8 | 1.8 | 50 | 120 |
| (30) | 475 | 60 | 1.76 | 0.21 | 8.4 | 1.8 | 50 | 120 |
| (31) | 220 | 11 | 0.79 | 0.04 | 19.8 | 1.8 | 50 | 70 |
| (32) | 450 | 103 | 1.62 | 0.36 | 4.5 | 1.8 | 50 | 70 |
| (33) | 286 | 60 | 1.03 | 0.21 | 4.9 | 1.8 | 50 | 70 |
| (34) | 409 | 20 | 1.47 | 0.07 | 21.0 | 1.8 | 50 | 70 |
| (35) | 380 | 20 | 1.37 | 0.07 | 19.6 | 0.9 | 50 | 120 |
| (36) | 380 | 20 | 1.37 | 0.07 | 19.6 | 4.1 | 50 | 120 |
| (37) | 340 | 60 | 1.22 | 0.21 | 5.8 | 1.8 | 39 | 120 |
| (38) | 340 | 60 | 1.22 | 0.21 | 5.8 | 1.8 | 71 | 120 |
| (39) | 340 | 60 | 1.22 | 0.21 | 5.8 | 1.8 | 50 | 49 |
| (40) | 340 | 60 | 1.22 | 0.21 | 5.8 | 1.8 | 50 | 155 |
| (41) | 320 | 80 | 1.15 | 0.28 | 4.1 | 2.0 | 50 | 70 |
| (42) | 450 | 100 | 1.62 | 0.35 | 4.6 | 2.5 | 65 | 145 |
| (43) | 135 | 15 | 0.49 | 0.05 | 9.8 | 1.8 | 50 | 70 |
| (44) | 475 | 60 | 1.76 | 0.21 | 8.4 | 1.8 50 | 70 | |
| (45) | 220 | 11 | 0.79 | 0.04 | 19.8 | 1.8 | 50 | 130 |
| (46) | 450 | 103 | 1.62 | 0.36 | 4.5 | 1.8 | 50 | 130 |
| (47) | 286 | 60 | 1.03 | 0.21 | 4.9 | 1.8 | 50 | 130 |
| (48) | 409 | 20 | 1.47 | 0.07 | 21.0 | 1.8 | 50 | 130 |
| (49) | 380 | 20 | 1.37 | 0.07 | 19.6 | 0.9 | 50 | 70 |
| (50) | 380 | 20 | 1.37 | 0.07 | 19.6 | 4.1 | 50 | 70 |
| (51) | 340 | 60 | 1.22 | 0.21 | 5.8 | 1.8 | 39 | 70 |
| (52) | 340 | 60 | 1.22 | 0.21 | 5.8 | 1.8 | 71 | 70 |

TABLE 3

| No. | | Alloying-treated Fe—Zn alloy dip-plating layer (lower layer) Dip-plating condition | Chemical composition (wt. %) Fe | Zn etc | Plating weight ($g/m^2$) | Reduction rate of temper rolling (%) | Fe—Zn alloy electroplating layer (upper layer) Fe—Zn alloy matrix Electro-plating condition | Chemical composition (wt. %) Fe | Zn | Dots of Fe—Zn alloy Chemical composition (wt. %) Fe | Zn | Total exposed area (%) | Diameter (μm) | Total plating weight ($g/m^2$) |
|---|---|---|---|---|---|---|---|---|---|---|---|---|---|---|
| Sample of the invention | 1 | A | 8.5 | 91.5 | 118 | 0.4 | (1) | 85 | 15 | 58 | 42 | 40 | 30 | 4.0 |
| | 2 | A | 8.5 | 91.5 | 118 | 0.8 | 93) | 75 | 25 | 55 | 45 | 20 | 50 | 4.0 |
| | 3 | A | 9.7 | 90.3 | 68 | 0.4 | (1) | 85 | 15 | 58 | 42 | 40 | 20 | 5.0 |
| | 4 | A | 9.7 | 90.3 | 68 | 0.8 | (3) | 75 | 25 | 55 | 45 | 20 | 40 | 7.0 |
| | 5 | A | 9.7 | 90.3 | 68 | 1.2 | (1) | 85 | 15 | 58 | 42 | 10 | 20 | 10.0 |
| | 6 | B | 10.2 | 89.8 | 56 | 0.4 | (1) | 85 | 15 | 58 | 42 | 35 | 10 | 4.0 |
| | 7 | B | 10.2 | 89.8 | 56 | 0.8 | (3) | 75 | 25 | 55 | 45 | 15 | 15 | 4.0 |
| | 8 | B | 11.2 | 88.8 | 56 | 1.2 | (1) | 85 | 15 | 58 | 42 | 35 | 5 | 5.0 |
| | 9 | B | 11.8 | 88.2 | 45 | 0.4 | (3) | 75 | 25 | 55 | 45 | 15 | 20 | 7.0 |
| | 10 | B | 11.8 | 88.2 | 45 | 0.8 | (1) | 85 | 15 | 58 | 45 | 5 | 25 | 10.0 |
| | 11 | F | 10.5 | 89.5 | 45 | 0.4 | (5) | 80 | 20 | 58 | 42 | 30 | 40 | 4.0 |
| | 12 | G | 10.7 | 89.3 | 45 | 0.4 | (9) | 83 | 17 | 56 | 44 | 35 | 20 | 4.0 |
| | 13 | H | 10.2 | 89.8 | 45 | 0.4 | (9) | 85 | 15 | 56 | 44 | 35 | 10 | 4.0 |
| | 14 | E | 7.0 | 93.0 | 90 | 0.8 | (8) | 62 | 38 | 30 | 70 | 20 | 80 | 4.0 |
| | 15 | D | 15.0 | 85.0 | 35 | 0.4 | (10) | 85 | 15 | 55 | 45 | 30 | 40 | 4.0 |
| | 16 | B | 12.0 | 88.0 | 30 | 0.4 | (10) | 85 | 15 | 58 | 42 | 30 | 40 | 4.0 |
| | 17 | A | 8.3 | 91.7 | 120 | 0.8 | (11) | 85 | 15 | 52 | 48 | 20 | 60 | 4.0 |
| | 18 | B | 10.2 | 89.8 | 56 | 0.3 | (14) | 75 | 25 | 50 | 50 | 40 | 15 | 4.0 |
| | 19 | B | 10.2 | 89.8 | 56 | 1.5 | (15) | 75 | 25 | 50 | 50 | 35 | 20 | 4.0 |
| | 20 | A | 10.0 | 90.0 | 55 | 0.8 | (1) | 85 | 15 | 58 | 42 | 45 | 40 | 1.0 |
| | 21 | A | 10.0 | 90.0 | 55 | 0.8 | (1) | 90 | 10 | 55 | 45 | 20 | 80 | 4.0 |
| | 22 | A | 10.0 | 90.0 | 55 | 0.8 | (1) | 85 | 15 | 59 | 41 | 20 | 80 | 4.0 |
| | 23 | B | 9.3 | 90.7 | 75 | 0.4 | (3) | 75 | 25 | 50 | 50 | 50 | 30 | 4.0 |
| | 24 | B | 8.0 | 92.0 | 115 | 0.4 | (3) | 75 | 25 | 45 | 55 | 40 | 100 | 4.0 |
| | 25 | C | 11.2 | 88.8 | 58 | 0.8 | (1) | 85 | 15 | 55 | 45 | 10 | 30 | 4.0 |
| | 26 | B | 10.2 | 89.8 | 56 | 0.8 | (18) | 60 | 40 | 48 | 52 | 20 | 20 | 4.0 |
| | 27 | B | 10.2 | 89.8 | 56 | 0.8 | (19) | 74 | 26 | 50 | 50 | 15 | 15 | 4.0 |
| | 28 | E | 9.5 | 90.5 | 65 | 0.8 | (27) | 85 | 15 | 55 | 45 | 25 | 70 | 4.0 |
| | 29 | B | 10.2 | 89.8 | 56 | 0.8 | (28) | 90 | 10 | 55 | 45 | 20 | 80 | 1.5 |

| | No. | Electropaintability: Production of bubbles | Production of crater-shaped pinholes | Press-formability ($g/m^2$) | Corrosion resistance |
|---|---|---|---|---|---|
| Sample of the invention | 1 | ○ | ○ | 11.0 | A |
| | 2 | ○ | ○ | 11.0 | A |

TABLE 3-continued

| | | | | |
|---|---|---|---|---|
| 3 | ○ | ○ | 5.3 | A |
| 4 | ○ | ○ | 5.7 | A |
| 5 | ○ | ○ | 5.8 | A |
| 6 | ○ | ○ | 3.2 | A |
| 7 | ○ | ○ | 3.0 | A |
| 8 | ○ | ○ | 3.6 | A |
| 9 | ○ | ○ | 1.6 | A |
| 10 | ○ | ○ | 1.5 | A |
| 11 | ○ | ○ | 1.5 | A |
| 12 | ○ | ○ | 1.6 | A |
| 13 | ○ | ○ | 1.4 | A |
| 14 | ○ | ○ | 7.6 | A |
| 15 | ○ | ○ | 1.3 | B |
| 16 | ○ | ○ | 1.2 | B |
| 17 | ○ | ○ | 11.5 | A |
| 18 | ○ | ○ | 3.5 | A |
| 19 | ○ | ○ | 3.6 | A |
| 20 | ○ | ○ | 3.0 | A |
| 21 | ○ | ○ | 3.2 | A |
| 22 | ○ | ○ | 3.1 | A |
| 23 | ○ | ○ | 6.4 | A |
| 24 | ○ | ○ | 10.2 | A |
| 25 | ○ | ○ | 3.5 | A |
| 26 | ○ | ○ | 3.4 | A |
| 27 | ○ | ○ | 3.4 | A |
| 28 | ○ | ○ | 3.3 | A |
| 29 | ○ | ○ | 3.5 | A |

TABLE 4

| | | Alloying-treated Fe—Zn alloy dip-plating layer (lower layer) | | | | | Fe—Zn alloy electroplating layer (upper layer) | | | | | |
|---|---|---|---|---|---|---|---|---|---|---|---|---|
| | | Dip-plating | Chemical composition (wt. %) | | Plating weight | Reduction rate of temper | Electro-plating | Chemical composition (wt. %) | | Total open area of pores | Pore diameter | Plating weight |
| | No. | condition | Fe | Zn etc | (g/m²) | rolling (%) | condition | Fe | Zn | (%) | (μm) | (g/m²) |
| Sample of the invention | 30 | A | 8.5 | 91.5 | 118 | 0.4 | (2) | 85 | 15 | 40 | 45 | 3 |
| | 31 | A | 8.5 | 91.5 | 118 | 0.8 | (4) | 75 | 25 | 25 | 20 | 3 |
| | 32 | A | 9.7 | 90.3 | 68 | 0.4 | (2) | 85 | 15 | 40 | 60 | 2 |
| | 33 | A | 9.7 | 90.3 | 68 | 0.8 | (4) | 75 | 25 | 26 | 15 | 3 |
| | 34 | A | 9.7 | 90.3 | 68 | 1.2 | (2) | 85 | 15 | 10 | 10 | 3 |
| | 35 | B | 10.2 | 89.8 | 56 | 0.4 | (2) | 85 | 15 | 35 | 25 | 4 |
| | 36 | B | 10.2 | 89.8 | 56 | 0.8 | (4) | 75 | 25 | 20 | 20 | 4 |
| | 37 | B | 11.2 | 88.8 | 56 | 1.2 | (2) | 85 | 15 | 35 | 10 | 3 |
| | 38 | B | 11.8 | 88.2 | 45 | 0.4 | (4) | 75 | 25 | 15 | 30 | 3 |
| | 39 | B | 11.8 | 88.2 | 45 | 0.8 | (2) | 85 | 15 | 5 | 20 | 3 |
| | 40 | D | 12.5 | 87.5 | 60 | 0.8 | (6) | 83 | 17 | 25 | 35 | 3 |
| | 41 | E | 8.0 | 92.0 | 60 | 0.8 | (6) | 83 | 17 | 30 | 50 | 3 |
| | 42 | H | 10.2 | 89.8 | 45 | 0.4 | (12) | 87 | 13 | 30 | 35 | 6 |
| | 43 | E | 7.0 | 93.0 | 90 | 0.8 | (12) | 87 | 13 | 50 | 40 | 6 |
| | 44 | D | 15.0 | 85.0 | 35 | 0.4 | (13) | 90 | 10 | 15 | 10 | 3 |
| | 45 | B | 12.0 | 88.0 | 30 | 0.4 | (13) | 90 | 10 | 10 | 15 | 3 |
| | 46 | A | 8.3 | 91.7 | 120 | 0.8 | 913) | 88 | 12 | 25 | 100 | 3 |
| | 47 | B | 10.2 | 89.8 | 56 | 0.3 | (16) | 60 | 40 | 37 | 25 | 1 |
| | 48 | B | 10.2 | 89.8 | 56 | 1.5 | (17) | 80 | 20 | 5 | 10 | 10 |
| | 49 | C | 10.5 | 89.5 | 65 | 0.8 | (4) | 75 | 25 | 20 | 20 | 3 |
| | 50 | F | 10.1 | 89.9 | 65 | 0.8 | (4) | 75 | 25 | 20 | 20 | 3 |
| | 51 | G | 10.2 | 89.8 | 65 | 0.8 | (4) | 75 | 25 | 20 | 20 | 3 |
| | 52 | B | 10.2 | 89.8 | 56 | 0.8 | (20) | 60 | 40 | 30 | 10 | 3 |
| | 53 | B | 10.2 | 89.8 | 56 | 0.8 | (21) | 70 | 30 | 15 | 18 | 3 |
| | 54 | B | 10.2 | 89.8 | 56 | 0.8 | (22) | 80 | 20 | 20 | 20 | 3 |
| | 55 | B | 10.2 | 89.8 | 56 | 0.8 | (23) | 60 | 40 | 15 | 25 | 3 |
| | 56 | B | 10.2 | 89.8 | 56 | 0.8 | (24) | 88 | 12 | 15 | 20 | 3 |
| | 57 | B | 10.2 | 89.8 | 56 | 0.8 | (25) | 85 | 15 | 25 | 30 | 3 |
| | 58 | B | 10.2 | 89.8 | 56 | 1.5 | (22) | 78 | 22 | 10 | 5 | 3 |

| | | Electropaintability | | | |
|---|---|---|---|---|---|
| | No. | Production of bubbles | Production of crater shaped pinholes | Press-formability (g/m²) | Corrosion resistance |
| Sample of the invention | 30 | ○ | ○ | 11.0 | A |
| | 31 | ○ | ○ | 11.0 | A |
| | 32 | ○ | ○ | 5.2 | A |
| | 33 | ○ | ○ | 5.8 | A |
| | 34 | ○ | ○ | 5.7 | A |
| | 35 | ○ | ○ | 3.2 | A |
| | 36 | ○ | ○ | 3.1 | A |
| | 37 | ○ | ○ | 3.5 | A |
| | 38 | ○ | ○ | 1.6 | A |
| | 39 | ○ | ○ | 1.4 | A |

TABLE 4-continued

| | | | | |
|---|---|---|---|---|
| 40 | ○ | ○ | 5.1 | A |
| 41 | ○ | ○ | 5.1 | A |
| 42 | ○ | ○ | 1.6 | A |
| 43 | ○ | ○ | 7.5 | A |
| 44 | ○ | ○ | 1.4 | B |
| 45 | ○ | ○ | 1.1 | B |
| 46 | ○ | ○ | 11.5 | A |
| 47 | ○ | ○ | 3.2 | A |
| 48 | ○ | ○ | 3.9 | A |
| 49 | ○ | ○ | 5.4 | A |
| 50 | ○ | ○ | 5.2 | A |
| 51 | ○ | ○ | 5.1 | A |
| 52 | ○ | ○ | 3.7 | A |
| 53 | ○ | ○ | 3.6 | A |
| 54 | ○ | ○ | 3.4 | A |
| 55 | ○ | ○ | 3.5 | A |
| 56 | ○ | ○ | 3.6 | A |
| 57 | ○ | ○ | 3.2 | A |
| 58 | ○ | ○ | 3.3 | A |

TABLE 5

| | | Alloy-treated Fe—Zn alloy dip-plating layer (lower layer) | | | | | Fe—Zn alloy electroplating layer (upper layer) | | | | | | | |
|---|---|---|---|---|---|---|---|---|---|---|---|---|---|---|
| | | | | | | | Fe—Zn alloy matrix | | | Dots of Fe—Zn alloy | | | | |
| | | Dip-plating | Chemical composition (wt. %) | | Plating weight | Reduction rate of temper | Electro-plating | Chemical composition (wt. %) | | Chemical composition (wt. %) | | Total exposed | Dia-meter | Total plating weight |
| No. | | condition | Fe | Zn | (g/m²) | rolling (%) | condition | Fe | Zn | Fe | Zn | area (%) | (μm) | (g/m²) |
| Sample for comparison | 1 | C | 13.0 | 87.0 | 65 | 0.4 | (41) | 55 | 45 | 45 | 55 | 30 | 40.0 | 5.0 |
| | 2 | A | 9.7 | 90.3 | 68 | 0.4 | (1) | 85 | 15 | 65 | 35 | 40 | 45.0 | 5.0 |
| | 3 | C | 13.5 | 86.5 | 65 | 1.2 | (1) | 85 | 15 | 58 | 42 | 1 | 15.0 | 5.0 |
| | 4 | A | 8.5 | 91.5 | 65 | 0.4 | (1) | 80 | 20 | 45 | 55 | 55 | 40.0 | 5.0 |
| | 5 | B | 10.2 | 89.8 | 55 | 1.2 | (1) | 85 | 15 | 57 | 43 | 10 | 4.0 | 6.0 |
| | 6 | A | 9.6 | 90.4 | 63 | 0.4 | (3) | 75 | 25 | 55 | 45 | 35 | 150.0 | 4.0 |
| | 7 | C | 10.5 | 89.5 | 62 | 0.8 | (4) | 75 | 25 | 56 | 44 | 40 | 20.0 | 0.5 |
| | 8 | C | 10.5 | 89.5 | 62 | 0.8 | (1) | 85 | 15 | 59 | 41 | 5 | 10.0 | 20.0 |
| | 9 | A | 9.7 | 90.3 | 68 | 0.2 | (1) | 85 | 15 | 25 | 75 | 15 | <2.0 | 10.0 |
| | 10 | N | 15.1 | 84.9 | 56 | 0.8 | (1) | 85 | 15 | 48 | 52 | 15 | 10.0 | 4.0 |
| | 11 | A | 9.0 | 91.0 | 125 | 0.8 | (1) | 85 | 15 | 45 | 55 | 23 | 15.0 | 4.0 |
| | 12 | A | 13.5 | 86.5 | 29 | 0.8 | (1) | 85 | 15 | 48 | 52 | 20 | 30.0 | 4.0 |
| | 13 | A | 9.7 | 90.3 | 68 | 1.6 | (1) | 85 | 15 | 45 | 55 | 5 | 5.0 | 4.0 |
| | 14 | A | 9.7 | 90.3 | 68 | 0.8 | (34) | 91 | 9 | 58 | 42 | 20 | 15.0 | 4.0 |
| | 15 | A | 9.7 | 90.3 | 68 | 0.8 | (39) | 63 | 37 | 60 | 40 | 40 | 60.0 | 4.0 |
| | 16 | B | 10.2 | 89.8 | 55 | 1.2 | (36) | — | — | — | — | — | — | — |
| | 17 | B | 10.2 | 89.8 | 55 | 1.2 | (37) | 80 | 20 | 48 | 52 | 30 | 110.0 | 4.0 |
| | 18 | I | 15.6 | 84.4 | 112 | 0.8 | (1) | 85 | 15 | 50 | 50 | 16 | 15.0 | 4.0 |
| | 19 | J | 6.8 | 93.2 | 68 | 0.8 | — | — | — | — | — | — | — | — |
| | 20 | K | — | — | — | — | — | — | — | — | — | — | — | — |
| | 21 | L | — | — | — | — | — | — | — | — | — | — | — | — |
| | 22 | N | — | — | — | — | — | — | — | — | — | — | — | — |
| | 23 | N | 15.8 | 84.2 | 56 | 0.8 | (1) | 85 | 15 | 55 | 45 | 20 | 25.0 | 4.0 |
| | 24 | B | 10.2 | 89.8 | 56 | 0.8 | (31) | — | — | — | — | — | — | — |
| | 25 | B | 10.2 | 89.8 | 56 | 0.8 | (32) | 55 | 45 | 45 | 55 | 25 | 30.0 | 4.0 |
| | 26 | B | 10.2 | 89.8 | 56 | 0.8 | (33) | 47 | 43 | 50 | 50 | 20 | 25.0 | 4.0 |
| | 27 | B | 10.2 | 89.8 | 56 | 0.8 | (34) | 95 | 5 | 70 | 30 | 20.0 | 4.0 | |
| | 28 | B | 10.2 | 89.8 | 56 | 0.8 | (39) | 60 | 40 | 60 | 40 | — | — | 4.0 |
| | 29 | B | 10.2 | 89.8 | 56 | 0.8 | (43) | 56 | 44 | 53 | 47 | 20 | 25.0 | 4.0 |
| | 30 | B | 10.2 | 89.8 | 56 | 0.8 | (44) | — | — | — | — | — | — | — |
| | 31 | B | 10.2 | 89.8 | 56 | 0.8 | (49) | — | — | — | — | — | — | — |
| | 32 | B | 10.2 | 89.8 | 56 | 0.8 | (50) | — | — | — | — | — | — | — |
| | 33 | B | 10.2 | 89.8 | 56 | 0.8 | (51) | — | — | — | — | — | — | — |
| | 34 | B | 10.2 | 89.8 | 56 | 0.8 | (52) | — | — | — | — | — | — | — |
| | 35 | B | 10.2 | 89.8 | 56 | 0.8 | (46) | 52 | 48 | 28 | 72 | 30 | 45.0 | 4.0 |
| | 36 | M | 6.9 | 93.1 | 90 | 0.8 | — | — | — | — | — | — | — | — |

| | | Electropaintability | | | |
|---|---|---|---|---|---|
| | No. | Production of bubbles | Production of crater-shaped pinholes | Press-formability (g/m²) | Corrosion resistance |
| Sample for comparison | | ○ | x | 5.2 | A |
| | 2 | x | ○ | 5.3 | A |
| | 3 | x | ○ | 7.5 | A |
| | 4 | ○ | x | 4.5 | A |
| | 5 | x | ○ | 5.1 | A |
| | 6 | ○ | x | 6.0 | A |
| | 7 | ○ | x | 5.5 | A |
| | 8 | x | ○ | 12.5 | A |
| | 9 | x | ○ | 7.5 | A |
| | 10 | x | ○ | 23.5 | A |

TABLE 5-continued

| | | | | |
|---|---|---|---|---|
| 11 | x | ∘ | 17.6 | A |
| 12 | ∘ | ∘ | 1.8 | C |
| 13 | x | ∘ | 7.5 | A |
| 14 | x | ∘ | 9.7 | C |
| 15 | x | ∘ | 7.8 | A |
| 16 | — | — | — | — |
| 17 | ∘ | x | 5.1 | A |
| 18 | x | ∘ | 25.0 | A |
| 19 | — | — | — | — |
| 20 | — | — | — | — |
| 21 | — | — | — | — |
| 22 | — | — | — | — |
| 23 | x | ∘ | 18.5 | A |
| 24 | — | — | — | — |
| 25 | ∘ | x | 4.3 | A |
| 26 | ∘ | x | 4.2 | A |
| 27 | ∘ | ∘ | 3.8 | D |
| 28 | x | ∘ | 5.8 | A |
| 29 | ∘ | x | 3.4 | A |
| 30 | — | — | — | — |
| 31 | — | — | — | — |
| 32 | — | — | — | — |
| 33 | — | — | — | — |
| 34 | — | — | — | — |
| 35 | ∘ | x | 3.7 | A |
| 36 | — | — | — | — |

TABLE 6

| | | Alloying-treated Fe—Zn alloy dip-plating layer (lower layer) | | | | | Fe—Zn alloy electroplating layer (upper layer) | | | | | |
|---|---|---|---|---|---|---|---|---|---|---|---|---|
| | | Dip-plating | Chemical composition (wt. %) | | Plating weight | Reduction rate of temper | Electro-plating | Chemical composition (wt. %) | | Total open are of pores | Pore diameter | Plating weight |
| | No. | condition | Fe | Zn etc | (g/m²) | rolling (%) | condition | Fe | Zn | (%) | (μm) | (g/m²) |
| Sample for comparison | 37 | A | 9.7 | 90.3 | 68 | 0.2 | (4) | 75 | 25 | 3 | 2 | 3.0 |
| | 38 | A | 9.7 | 90.3 | 68 | 1.6 | (4) | 75 | 25 | <2 | <1 | 3.0 |
| | 39 | B | 10.2 | 89.8 | 56 | 0.4 | (2) | 85 | 15 | 35 | 25 | 0.5 |
| | 40 | B | 10.2 | 89.8 | 56 | 0.4 | (2) | 85 | 15 | 35 | 25 | 11.0 |
| | 41 | A | 9.6 | 90.4 | 63 | 0.4 | (2) | 85 | 15 | 35 | 110 | 4.0 |
| | 42 | N | 15.1 | 84.9 | 56 | 0.8 | (2) | 85 | 15 | 10 | 5 | 3.0 |
| | 43 | A | 6.5 | 93.5 | 45 | 0.8 | (2) | 85 | 15 | 6 | 5 | 4.0 |
| | 44 | A | 9.0 | 91.0 | 125 | 0.8 | (2) | 88 | 12 | 19 | 15 | 3.0 |
| | 45 | A | 13.5 | 86.5 | 29 | 0.8 | (2) | 88 | 12 | 17 | 5 | 3.0 |
| | 46 | B | 10.2 | 89.8 | 56 | 0.8 | (41) | 59 | 41 | 15 | 5 | 3.0 |
| | 47 | B | 10.2 | 89.8 | 56 | 0.8 | (34) | 91 | 9 | 35 | 20 | 3.0 |
| | 48 | B | 10.2 | 89.8 | 56 | 0.4 | (40) | 89 | 11 | 55 | 60 | 3.0 |
| | 49 | B | 10.2 | 89.8 | 56 | 0.4 | (2) | 85 | 15 | 10 | 5 | 0.8 |
| | 50 | I | 15.6 | 84.4 | 112 | 0.8 | (2) | 85 | 15 | 10 | 10 | 3.0 |
| | 51 | J | 6.8 | 93.2 | 68 | 0.8 | — | — | — | — | — | — |
| | 52 | K | — | — | — | — | — | — | — | — | — | — |
| | 53 | L | — | — | — | — | — | — | — | — | — | — |
| | 54 | M | — | — | — | — | — | — | — | — | — | — |
| | 55 | B | 10.2 | 89.8 | 56 | 0.8 | (30) | — | — | — | — | — |
| | 56 | B | 10.2 | 89.8 | 56 | 0.8 | (35) | — | — | — | — | — |
| | 57 | B | 10.2 | 89.8 | 56 | 0.8 | (36) | — | — | — | — | — |
| | 58 | B | 10.2 | 89.8 | 56 | 0.8 | (37) | — | — | — | — | — |
| | 59 | B | 10.2 | 89.8 | 56 | 0.8 | (38) | — | — | — | — | — |
| | 60 | B | 10.2 | 89.8 | 56 | 0.8 | (40) | — | — | — | — | — |
| | 61 | B | 10.2 | 89.8 | 56 | 0.8 | (45) | — | — | — | — | — |
| | 62 | B | 10.2 | 89.8 | 56 | 0.8 | (46) | 54 | 46 | 35 | 40 | 3.0 |
| | 63 | B | 10.2 | 89.8 | 56 | 0.8 | (47) | 57 | 43 | 28 | 35 | 3.0 |
| | 64 | B | 10.2 | 89.8 | 56 | 0.8 | (48) | 86 | 4 | 33 | 10 | 3.0 |

| | | Electropaintability | | | |
|---|---|---|---|---|---|
| | No. | Production of bubbles | Production of crater-shaped pinholes | Press-formability (g/m²) | Corrosion resistance |
| Sample for comparison | 37 | x | ∘ | 7.1 | A |
| | 38 | x | ∘ | 10.2 | A |
| | 39 | ∘ | x | 3.0 | C |
| | 40 | x | ∘ | 10.5 | A |
| | 41 | ∘ | x | 3.5 | A |
| | 42 | x | ∘ | 25.0 | A |
| | 43 | ∘ | ∘ | 3.5 | A |
| | 44 | x | ∘ | 28.5 | A |
| | 45 | ∘ | ∘ | 1.9 | A |
| | 46 | ∘ | x | 3.6 | A |
| | 47 | x | ∘ | 4.3 | C |
| | 48 | ∘ | x | 3.7 | A |

TABLE 6-continued

| | | | | |
|---|---|---|---|---|
| 49 | ∘ | x | 3.5 | C |
| 50 | x | ∘ | 24.5 | A |
| 51 | — | — | — | — |
| 52 | — | — | — | — |
| 53 | — | — | — | — |
| 54 | — | — | — | — |
| 55 | — | — | — | — |
| 56 | — | — | — | — |
| 57 | — | — | — | — |
| 58 | — | — | — | — |
| 59 | — | — | — | — |
| 60 | — | — | — | — |
| 61 | — | — | — | — |
| 62 | ∘ | x | 3.8 | A |
| 63 | ∘ | x | 3.6 | A |
| 64 | ∘ | ∘ | 3.4 | D |

Then, the cold-rolled steel sheet 1, on each of the both surfaces of which the alloying-treated iron-zinc alloy dip-plating layer having the fine irregularities has thus been formed, was subjected to a temper rolling treatment at a reduction rate as shown in Tables 3 and 4, to level the numerous fine convexities on the surface of the alloying-treated iron-zinc alloy dip-plating layer, so as to form, on each of the both surfaces of the cold-rolled steel sheet 1, an alloying-treated iron-zinc alloy dip-plating layer 2 as a lower layer having the numerous fine concavities on the surface thereof.

Then, the cold-rolled steel sheet 1, on each of the both surfaces of which the alloying-treated iron-zinc alloy dip-plating layer 2 as the lower layer having the numerous fine concavities has thus been formed, was subjected to an iron-zinc alloy electroplating treatment under any one of electroplating conditions (1) to (28) as shown in Table 2 (1), to form, on the alloying-treated iron-zinc alloy dip-plating layer 2 as the lower layer, an iron-zinc alloy electroplating layer 3 or 4 as an upper layer. There were thus prepared samples of the first iron-zinc alloy plated steel sheet within the scope of the present invention (hereinafter referred to as the "samples of the invention") Nos. 1 to 29 as shown in Table 3, and samples of the second iron-zinc alloy plated steel sheet within the scope of the present invention (hereinafter referred to as the "samples of the invention") Nos. 30 to 58 as shown in Table 4. Each of the samples of the invention Nos. 1 to 29 had two plating layers comprising the alloying-treated iron-zinc alloy dip-plating layer 2 as the lower layer and the iron-zinc alloy electroplating layer 3 as the upper layer, and the iron-zinc alloy electroplating layer 3 as the upper layer comprised an iron-zinc alloy matrix 3*a* and a plurality of dots of iron-zinc alloy formed in the iron-zinc alloy matrix 3*a*. Each of the samples of the invention Nos. 30 to 58 also had two plating layers comprising the alloying-treated iron-zinc alloy dip-plating layer 2 as the lower layer and the iron-zinc alloy electroplating layer 4 as the upper layer, and the iron-zinc alloy electroplating layer 4 as the upper layer had the plurality of pores 4*a*.

For comparison purposes, samples of the iron-zinc alloy plated steel sheet outside the scope of the present invention were prepared as follows: More specifically, the both surfaces of each of cold-rolled steel sheets having a thickness of 0.8 mm were cleaned by means of a usual alkali degreasing and a usual electrolytic pickling. Then, each of the thus cleaned cold-rolled steel sheets was subjected to a zinc dip-plating treatment under any one of fourteen kinds of zinc dip-plating conditions A to N as shown in Table 1 to form a zinc iron-zinc alloy dip-plating layer on each of the both surfaces of the cold-rolled steel sheet, Then, the cold-rolled steel sheet 1, on the surface of which the zinc dip-plating layer has thus been formed, was heated to an alloying treatment temperature as shown in Table 1, to apply an alloying treatment to the entirety of the zinc dip-plating layer and a surface Portion Of the cold-rolled steel sheet, so as to form, on the both surfaces Of the cold-rolled steel sheet, an alloying-treated iron-zinc alloy dip-plating layer.

Then, the cold-rolled steel sheet, on each of the both surfaces of which the above-described alloying-treated iron-zinc alloy dip-plating layer has thus been formed, was subjected to a temper rolling treatment at a reduction rate as shown in Tables 5 (1) and 5 (2) and Table 6, to form, on each of the both surfaces of the cold-rolled steel sheet, an alloying-treated iron-zinc alloy dip-plating layer as a lower layer.

Then, the cold-rolled steel sheet, on each of the both surfaces of which the alloying-treated iron-zinc alloy dip-plating layer as the lower layer has thus been formed, was subjected to an iron-zinc alloy electroplating treatment under any one of electroplating conditions (1) to (52) as shown in Tables 2 (1) and 2 (2), to form, on the alloying-treated iron-zinc alloy dip-plating layer as the lower layer, an iron-zinc alloy electroplating layer as an upper layer. There were thus prepared sample of the iron-zinc alloy plated steel sheet outside the scope of the present invention (hereinafter referred to as the "samples for comparison") Nos. 1 to 36 as shown in Tables 5 (1) and 5 (2), and samples of the iron-zinc alloy plated steel sheet outside the scope of the present invention (hereinafter referred to as the "samples for comparison") Nos. 37 to 64 as shown in Table 6.

Each of the samples for comparison Nos. 1 to 15, 17, 18, 23, 25 to 29, and 35 had two plating layers comprising the alloying-treated iron-zinc alloy dip-plating layer as the lower layer and the iron-zinc alloy electroplating layer as the upper layer, and the iron-zinc alloy electroplating layer as the upper layer comprised an iron-zinc alloy matrix and a plurality of dots of iron-zinc alloy formed in the iron-zinc alloy matrix.

In each of the samples for comparison Nos. 16 and 32, the iron-zinc alloy electroplating layer as the upper layer having a good appearance could not be formed, because a large amount of sludge was produced in the acidic electroplating bath in the iron-zinc alloy electroplating treatment due to the above-described acidic electroplating bath having a high pH value of 4.1 outside the scope of the present invention.

In the sample for comparison No. 19, the iron-zinc alloy electroplating layer as the upper layer was not formed, because unalloyed portions were remained in the alloying-treated iron-zinc alloy dip-plating layer as the lower layer due to the zinc dip-plating bath in the zinc dip-plating treatment having a high aluminum content of 0.16 outside the scope of the present invention.

In the sample for comparison No. 20, there could not be formed the zinc dip-plating layer covering the entire surface of the steel sheet, because the smoothness of the formed zinc dip-plating layer was deteriorated due to the zinc dip-plating bath in the zinc dip-plating treatment having a low temperature of 445° C. outside the scope of the present invention.

In the sample for comparison No. 21, there could not be formed the zinc dip-plating layer covering the entire surface of the steel sheet, because the smoothness of the formed zinc dip-plating layer was deteriorated due to the zinc dip-plating bath in the zinc dip-plating treatment having a high temperature of 485° C. outside the scope of the present invention.

In each of the samples for comparison Nos. 22 and 36, the alloying-treated iron-zinc alloy dip-plating layer as the lower layer could not be formed, because it was impossible to sufficiently alloy the zinc dip-plating layer formed on the surface of the steel sheet and the surface portion of the steel sheet, due to a low alloying treatment temperature of 415° C. outside the scope of the present invention.

In the sample for comparison No. 24, the iron-zinc alloy electroplating layer as the upper layer having a good appearance could not be formed, because a burnt deposit was produced in the iron-zinc alloy electroplating layer as the upper layer due to the acidic electroplating bath in the iron-zinc alloy electroplating treatment having a low zinc ion content of 0.04 mole/l outside the scope of the present invention.

In the sample for comparison No. 30, the iron-zinc alloy electroplating layer as the upper layer having a good appearance could not be formed, because a large amount of sludge was produced in the acidic electroplating bath in the iron-zinc alloy electroplating treatment due to the acidic electroplating bath having a high iron ion content of 1.76 mole/l outside the scope of the present invention.

In the sample for comparison No. 31, the iron-zinc alloy electroplating layer as the upper layer could not be efficiently formed, because the electroplating efficiency was deteriorated due to the acidic electroplating bath in the iron-zinc alloy electroplating treatment having a low pH value of 0.9 outside the scope of the present invention.

In the sample for comparison No. 33, the iron-zinc alloy electroplating layer as the upper layer having a good appearance could not be formed, because a burnt deposit was produced in the iron-zinc alloy electroplating layer as the upper layer due to the acidic electroplating bath in the iron-zinc alloy electroplating treatment having a low temperature of 39° C. outside the scope of the present invention.

In the sample for comparison No. 34, the iron-zinc alloy electroplating layer as the upper layer having a good appearance could not be formed, because a large amount of sludge was produced in the acidic electroplating bath in the iron-zinc alloy electroplating treatment due to the acidic electroplating bath having a high temperature of 71° C. outside the scope of the present invention.

Each of the samples for comparison Nos. 37 to 50, and 62 to 64 had two plating layers comprising the alloying-treated iron-zinc alloy dip-plating layer as the lower layer and the iron-zinc alloy electroplating layer as the upper layer, and the iron-zinc alloy electroplating layer as the upper layer had a plurality of pores therein.

In the sample for comparison No. 51, the iron-zinc alloy electroplating layer as the upper layer was not formed, because unalloyed portions were remained in the alloying-treated iron-zinc alloy dip-plating layer as the lower layer due to the zinc dip-plating bath in the zinc dip-plating treatment having a high aluminum content of 0.16 outside the scope of the present invention.

In the sample for comparison No. 52, there could not be formed the zinc dip-plating layer covering the entire surface of the steel sheet, because the smoothness of the formed zinc dip-plating layer was deteriorated due to the zinc dip-plating bath in the zinc dip-plating treatment having a low temperature of 445° C. outside the scope of the present invention.

In the sample for comparison No. 53, there could not be formed the zinc dip-plating layer covering the entire surface of the steel sheet, because the smoothness of the formed zinc dip-plating layer was deteriorated due to the zinc dip-plating bath in the zinc dip-plating treatment having a high temperature of 485° C. outside the scope of the present invention.

In the sample for comparison No. 54, the alloying-treated iron-zinc alloy dip-plating layer as the lower layer could not be formed, because it was impossible to sufficiently alloy the zinc dip-plating layer formed on the surface of the steel sheet and the surface portion of the steel sheet, due to a low alloying treatment temperature of 415° C. outside the scope of the present invention.

In the sample for comparison No. 55, the iron-zinc alloy electroplating layer as the upper layer having a good appearance could not be formed, because a large amount of sludge was produced in the acidic electroplating bath in the iron-zinc alloy electroplating treatment due to the acidic electroplating bath having a high iron ion content of 1.76 mole/l outside the scope of the present invention.

In the sample for comparison No. 56, the iron-zinc alloy electroplating layer as the upper layer could not be efficiently formed, because the electroplating efficiency was deteriorated due to the acidic electroplating bath in the iron-zinc alloy electroplating treatment having a low pH value of 0.9 outside the scope of the present invention.

In the sample for comparison No. 57, the iron-zinc alloy electroplating layer as the upper layer having a good appearance could not be formed, because an large amount of sludge was produced in the acidic electroplating bath in the iron-zinc alloy electroplating treatment due to the above-described acidic electroplating bath having a high pH value of 4.1 outside the scope of the present invention.

In the sample for comparison No. 58, the iron-zinc alloy electroplating layer as the upper layer having a good appearance could not be formed, because a burnt deposit was produced in the iron-zinc alloy electroplating layer as the upper layer due to the acidic electroplating bath in the iron-zinc alloy electroplating treatment having a low temperature of 39° C. outside the scope of the present invention.

In the sample for comparison No. 59, the iron-zinc alloy electroplating layer as the upper layer having a good appearance could not be formed, because a large amount of sludge was produced in the acidic electroplating bath in the iron-zinc alloy electroplating treatment due to the acidic electroplating bath having a high temperature of 71° C. outside the scope of the present invention.

In the sample for comparison No. 60, the iron-zinc alloy electroplating layer as the upper layer having a good appearance could not be formed, because a burnt deposit was produced in the iron-zinc alloy electroplating layer as the upper layer due to a high electric current density in the iron-zinc alloy electroplating treatment of 155 A/dm$^2$ outside the scope of the present invention.

In the sample for comparison No. 61, the iron-zinc alloy electroplating layer as the upper layer having a good appearance could not be formed, because a burnt deposit was produced in the iron-zinc alloy electroplating layer as the upper layer due to the acidic electroplating bath in the iron-zinc alloy electroplating treatment having a low zinc ion content of 0.04 mole/l outside the scope of the present invention.

For each of the samples of the invention Nos. 1 to 58 having the two plating layers and the samples for comparison Nos. 1 to 15, 17, 18, 23, 25 to 29, 35, 37 to 50, and 62 to 64 having the two plating layers, electropaintability, press-formability and corrosion resistance were investigated through the following performance tests. The results of these tests are also shown in Tables 3, 4, 5(1), 5(2), and 6.

(1) Electropaintability Test (a) Production of bubbles in paint film:

Each sample was subjected to an immersion-type phosphating treatment in a phosphating solution to form a phosphate film on each of the both surfaces of each sample, then subjected to a cation-type electropainting treatment to form a paint film having a thickness of 20 μm on each phosphate film under the following conditions:

Impressed voltage: 260 V,
Paint temperature: 27° C.,
Ratio of sample surface/anode surface: 1/1,
Baking temperature: 270° C., and
Baking time: 10 minutes.

Production of bubbles in the paint film thus formed on each sample was investigated through the visual inspection, and was evaluated in accordance with the following criteria:

○: No bubbles are produced in the paint film;
Δ: one to ten bubbles are produced in the paint film; and
×: over ten bubbles are produced in the paint film.

(b) Production of crater-shaped pinholes in paint film:

Each sample was subjected to an immersion-type phosphating treatment in a phosphating solution to form a phosphate film on each of the both surfaces of each sample, and then subjected to a cation-type electropainting treatment to form a paint film having a thickness of 20 μm on each phosphate film under the following conditions:

Impressed voltage: 280 V,
Paint temperature: 27° C.,
Ratio of sample surface/anode surface: 1/1,
Baking temperature: 170° C., and
Baking time: 25 minutes.

Production of crater-shaped pinholes in the paint film thus formed on each sample was investigated through the visual inspection, and was evaluated in accordance with the following criteria:

○: up to 20 crater-shaped pinholes are produced in the paint film;
Δ: from over 20 to up to 100 crater-shaped pinholes are produced in the paint film; and
×: over 100 crater-shaped pinholes are produced in the paint film.

(2) Press-formability test

Figure 5:
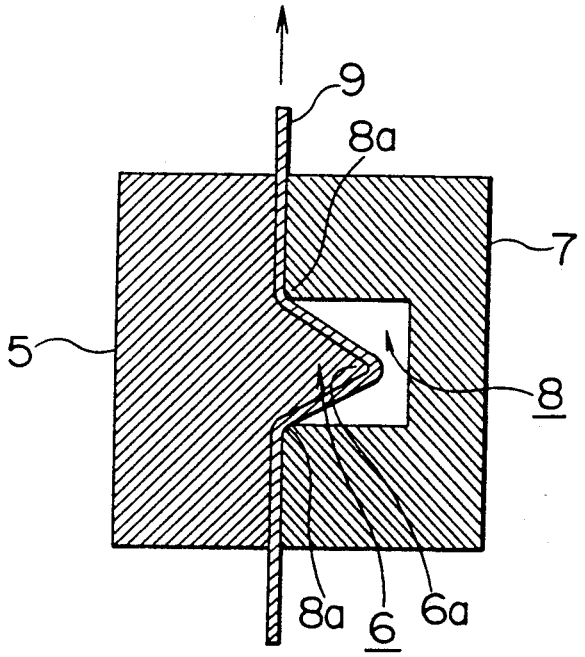
FIG. 5 is a schematic vertical sectional view illustrating a draw-bead tester for testing press-formability of an iron-zinc alloy plated steel sheet.

Press-formability of each sample was investigated by the use of a draw-bead tester as shown in the schematic vertical sectional view of FIG. 5.

As shown in FIG. 5, the draw-bead tester comprises a male die 5 having a substantially horizontal projection 6 with a prescribed height, and a female die 7 having a groove 8 with a prescribed depth facing the projection 6 of the male die 5. While the male die 5 is stationarily secured, the female die 7 is horizontally movable toward the male die 5 by means of a hydraulic cylinder not shown. A tip 6*a* of the projection 6 of the male die 5 has a radius of 0.5 mm. A shoulder 8*a* of the groove 8 of the female die 7 has a radius of 1 mm. The projection 6 of the male die 5 and the groove 8 of the female die 7 have a width of 40 mm.

A test piece 9 (i.e., each of the samples of the invention Nos. 1 to 58 and the samples for comparison Nos. 1 to 15, 17, 18, 23, 25 to 29, 35, 37 to 50, and 62 to 64) having a width of 30 mm was vertically inserted into the gap between the male die 5 and the female die 7 of the above-mentioned draw-bead tester, and by operating the hydraulic cylinder not shown, the test piece 9 was pressed against the projection 6 of the male die 5 and the shoulders 8*a* of the groove 8 of the female die 7 under a pressure of 500 Kgf/cm$^2$. Then, the test piece 9 was pulled out upward as shown by the arrow in FIG. 5 to squeeze same. Then, an adhesive tape was stuck to the iron-zinc alloy electroplating layer as the upper layer of the thus squeezed test piece 9, and then the adhesive tape was peeled off. The amount of peeloff of the iron-zinc alloy electroplating layer was measured and press-formability was evaluated from the thus measured amount of peeloff.

(3) Corrosion resistance test

Each sample was subjected to an immersion-type phosphating treatment in a phosphating solution to form a phosphate film on each of the both surfaces of each sample, and then subjected to a cation-type electropainting treatment to form a paint film having a thickness of 20 μm on each phosphate film under the following conditions:

Impressed voltage: 280 V,
Paint temperature: 27° C.,
Ratio of sample surface/anode surface: 1/1,
Baking temperature: 170° C., and
Baking time: 25 minutes.

Then, a notch was provided on the thus formed paint film. A salt spray test was carried out on the sample having the thus notched paint film. More specifically, the sample was exposed to the open air for a period of one year, during which salt water having a sodium chloride content of 5 wt. % was sprayed over the sample at a rate of twice a week. Then, the maximum blister width of the paint film was measured on one side of the notch on the sample after the salt spray test, and corrosion resistance was evaluated by means of the thus measured maximum blister width of the paint film. The criteria for evaluation were as follows:

A: a maximum blister width of under 1 mm;

B: a maximum blister width within a range of from 1 mm to under 2 mm;

C: a maximum blister width within a range of from 2 mm to under 2.5 mm; and

D: a maximum blister width of at least 2.5 mm.

As is clear from Tables 3 and 4, the samples of the invention Nos. 1 to 29 and the samples of the invention Nos. 30 to 58 were all excellent in electropaintability, press-formability and corrosion resistance.

More specifically, in the samples of the invention Nos. 1 to 58, no bubbles were produced in the paint film and the number of the crater-shaped pinholes produced in the paint film was as small as up to 20 in the electropaintability test, with a result that all the samples of the invention Nos. 1 to 58 were all excellent in electropaintability.

In the samples of the invention Nos. 1 to 58, the measured amount of peeloff of the iron-zinc alloy electroplating layer as the upper layer was as small as within a range of from 1.1 to 11.5 g/m$^2$ in the press-formability test, with a result that the samples of the invention Nos. 1 to 58 were all excellent in press-formability.

In the samples of the invention Nos. 1 to 58, the measured maximum blister width was as small as under 2 mm in the corrosion resistance test, with a result that the samples of the invention Nos. 1 to 58 were all excellent in corrosion resistance.

On the contrary, as is clear from Tables 5(1), 5(2) and 6, the samples for comparison Nos. 1 to 15, 17, 18, 23, 25 to 29, and 35 and the samples for comparison Nos. 37 to 50, and 62 to 64 were all inferior in at least one of electropaintability, press-formability and corrosion resistance.

More specifically, although no bubbles were produced in the paint film in the electropaintability test in the samples for comparison Nos. 1, 4, 6, 7, 12, 17, 25 to 27, 35, 39, 41, 43, 45, 46, 48, 49, and 62 to 64, over 10 bubbles were produced in the paint film in the electropaintability test in the samples for comparison Nos. 2, 3, 5, 8 to 11, 13 to 15, 18, 23, 28, 37, 38, 40, 42, 44, 47, and 50.

Although the samples for comparison Nos. 2, 3, 5, 8, 9 to 15, 18, 23, 27, 28, 37, 38, 40, 42 to 45, 47, 50, and 64 showed the production of crater-shaped pinholes of up to 20 in the paint film in the electropaintability test, the samples for comparison Nos. 1, 4, 6, 7, 17, 25, 26, 29, 35, 39, 41, 46, 48, 49, 62, and 63 showed the production of crater-shaped pinholes of over 100 in the paint film in the electropaintability test.

As a result, the samples for comparison Nos. 1 to 11, 13 to 15, 18, 23, 25, 26, 28, 29, 35, 37 to 42, 44, 46 to 50, 62, and 63 were all inferior in electropaintability.

In the samples for comparison Nos. 1 to 7, 9, 12 to 15, 17, 25 to 29, 35, 37 to 41, 43, 45 to 49, and 62 to 64, the measured amount of peeloff of the iron-zinc alloy electroplating layer as the upper layer was as small as within a range of from 1.8 to 10.5 g/m$^2$ in the press-formability test, with a result that these samples were all excellent in press-formability. However, in the samples for comparison Nos. 8, 10, 11, 18, 23, 42, 44 and 50, the measured amount of peeloff of the iron-zinc alloy electroplating layer as the upper layer was as large as within a range of from 12.5 to 28.5 g/m$^2$ in the press-formability test, with a result that these samples were all inferior in press-formability.

In the samples for comparison Nos. 1 to 11, 13, 15, 17, 18, 23, 25, 26, 28, 29, 35, 37, 38, 40 to 46, 48, 50, 62, and 63, the measured maximum blister width was as small as under 2 mm in the corrosion resistance test, with a result that these samples were all excellent in corrosion resistance. However, in the samples for comparison Nos. 12, 14, 27, 39, 47, 49 and 64, the measured maximum blister width was as large as at least 2 mm in the corrosion resistance test, with a result that these samples were all inferior in corrosion resistance.

According to the present invention, as described above in detail, it is possible to provide a method for manufacturing an iron-zinc alloy plated steel sheet having two plating layers, in which such defects as bubbles and pinholes are not produced in the paint film even when subjected to a severe press-forming, and which is excellent in electropaintability and press-formability, thus providing industrially useful effects.

What is claimed is:

1. A method for manufacturing an iron-zinc alloy plated steel sheet having two plating layers and excellent in electropaintability and press-formability, which comprises the steps of:

passing a steel sheet through a zinc dip-plating bath having a temperature within a range of from 450° to 480° C. and having a chemical composition comprising:

aluminum: from 0.10 to 0.15 wt. %, and the balance being zinc and incidental impurities, to apply a zinc dip-plating treatment to said steel sheet, so as to form, on at least one surface of said steel sheet, a zinc dip-plating layer having a plating weight within a range of from 30 to 120 g/m$^2$ per surface of said steel sheet; then heating said steel sheet, on the surface of which said zinc dip-plating layer has thus been formed, to a temperature within a range of from 420° to 520° C. to apply an alloying treatment to form, on said at least one surface of said steel sheet, an alloying-treated iron-zinc alloy dip-plating layer, said alloying-treated iron-zinc alloy dip-plating layer having on the surface thereof fine irregularities comprising numerous fine concavities and numerous fine convexities, and said alloying-treated iron-zinc alloy dip-plating layer having an iron content within a range of from 7 to 15 wt. % relative to said alloying-treated iron-zinc alloy dip-plating layer and having a plating weight within a range of from 30 to 120 g/m$^2$ per surface of said steel sheet; then applying a temper rolling treatment at a reduction rate within a range of from 0.3 to 1.5% to said steel sheet, on the surface of which said alloying-treated iron-zinc alloy dip-plating layer having said fine irregularities has thus been formed, to level said numerous fine convexities on the surface of said alloying-treated iron-zinc alloy dip-plating layer, so as to form, on said at least one surface of said steel sheet, an alloying-treated iron-zinc alloy dip-plating layer as a lower layer having said numerous fine concavities on the surface thereof; and then applying an iron-zinc alloy electroplating treatment to said steel sheet, on the surface of which said alloying-treated iron-zinc alloy dip-plating layer as the lower layer having said numerous fine concavities has thus been formed, with an electric current density within a range of from 50 to 150 A/dm$^2$ in an acidic electroplating bath having a PH value within a range of from 1.0 to 4.0 and a temperature within a range of from 40° to 70° C. and having a chemical composition comprising:

iron ions: from 0.50 to 1.75 mole/l, and zinc ions: from 0.05 to 0.35 mole/l, where, the ratio of the concentration of said iron ions to the concentration of said zinc ions being within a range of from 5 to 20, to form, on said alloying-treated iron-zinc alloy dip-plating layer as the lower layer, an iron-zinc alloy electroplating layer as an upper layer having a plating weight within a range of from 1 to 10 g/m$^2$ per surface of said steel sheet.

2. A method as claimed in claim 1, wherein:

said electric current density in said iron-zinc alloy electroplating treatment is limited within a range of from 50 to under 100 A/dm$^2$ so as to form, on said alloying-treated iron-zinc alloy dip-plating layer as the lower layer, said iron-zinc alloy electroplating layer as the upper layer comprising an iron-zinc alloy matrix and a plurality of dots of iron-zinc alloy formed in said iron-zinc alloy matrix, said iron-zinc alloy matrix having an iron content within a range of from 60 to 90 wt. % relative to said iron-zinc alloy matrix, each of said plurality of dots of iron-zinc alloy having an iron content within a range of from 30 to under 60 wt. % relative to said each of said plurality of dots, each of said plurality of dots being formed at a portion of said iron-zinc alloy matrix of said iron-zinc alloy electroplating layer as the upper layer, which portion corresponds to each of said numerous fine concavities on the surface of said alloying-treated iron-zinc alloy dip-plating layer as the lower layer, a total exposed area per unit area of said plurality of dots being within a range of from 5 to 50% of the unit area of said iron-zinc alloy electroplating layer as the upper layer, and each of said plurality of dots having a diameter within a range of from 5 to 100 μm.

3. A method as claimed in claim 2, wherein:

said aluminum content in said zinc dip-plating bath in said zinc dip-plating treatment is limited within a range of from 0.12 to 0.14 wt. %.

4. A method as claimed in claim 2, wherein:

said reduction rate in said temper rolling treatment is limited within a range of from 0.4 to 1.2%.

5. A method as claimed in claim 2, wherein:

said pH value of said acidic electroplating bath in said iron-zinc alloy electroplating treatment is limited within a range of from 1.5 to 2.5.

6. A method as claimed in claim 2, wherein:

said plating weight of said iron-zinc alloy electroplating layer as the upper layer is limited within a range of from 1.5 to 5.0 g/m$^2$ per surface of said steel sheet.

7. A method as claimed in claim 2, wherein:

said diameter of each of said plurality of dots of iron-zinc alloy in said iron-zinc alloy electroplating layer as the upper layer is limited within a range of from 10 to 70 μm.

8. A method as claimed in claim 1, wherein:

said electric current density in said iron-zinc alloy electroplating treatment is limited within a range of from 100 to 150 A/dm$^2$ so as to form, on said alloying-treated iron-zinc alloy dip-plating layer as the lower layer, said iron-zinc alloy electroplating layer as the upper layer having a plurality of pores, said iron-zinc alloy electroplating layer as the upper layer having an iron content within a range of from 60 to 90 wt. % relative to said iron-zinc alloy electroplating layer as the upper layer, each of said plurality of pores being formed at a portion of said iron-zinc alloy electroplating layer as the upper layer, which portion corresponds to each of said numerous fine concavities on the surface of said alloying-treated iron-zinc alloy dip-plating layer as the lower layer, a total opening area per unit area of said plurality of pores being within a range of from 5 to 50% of the unit area of said iron-zinc alloy electroplating layer as the upper layer, and each of said plurality of pores having a diameter within a range of from 5 to 100 μm.

9. A method as claimed in claim 8, wherein:

said aluminum content in said zinc dip-plating bath in said zinc dip-plating treatment is limited within a range of from 0.12 to 0.14 wt. %.

10. A method as claimed in claim 8, wherein:

said reduction rate in said temper rolling treatment is limited within a range of from 0.4 to 1.2%.

11. A method as claimed in claim 8, wherein:

said pH value of said acidic electroplating bath in said iron-zinc alloy electroplating treatment is limited within a range of from 1.5 to 2.5.

12. A method as claimed in claim 8, wherein:

said plating weight of said iron-zinc alloy electroplating layer as the upper layer is limited within a range of from 1.5 to 5.0 g/m$^2$ per surface of said steel sheet.

13. A method as claimed in claim 8, wherein:

said diameter of each of said plurality of pores in said iron-zinc alloy electroplating layer as the upper layer is limited within a range of from 10 to 70 μm.

14. A method as claimed in claim 3, wherein:

said reduction rate in said temper rolling treatment is within a range of from 0.4 to 1.2%.

15. A method as claimed in claim 4, wherein:

said pH value of said acidic electroplating bath in said iron-zinc alloy electroplating treatment is within a range of from 1.5 to 2.5.

16. A method as claimed in claim 5, wherein:

said plating weight of said iron-zinc alloy electroplating layer as the upper layer is within a range of from 1.5 to 5.0 g/m$^2$ per surface of said steel sheet.

17. A method as claimed in claim 6, wherein:

said diameter of each of said plurality of dots of iron-zinc alloy in said iron-zinc alloy electroplating layer as the upper layer is within a range of from 10 to 70 μm.

18. A method as claimed in claim 9, wherein:

said reduction rate in said temper rolling treatment is within a range of from 0.4 to 1.2%.

19. A method as claimed in claim 18, wherein:

said pH value of said acidic electroplating bath in said iron-zinc alloy electroplating treatment is within a range of from 1.5 to 2.5.

20. A method as claimed in claim 19, wherein:

said plating weight of said iron-zinc alloy electroplating layer as the upper layer is within a range of from 1.5 to 5.0 g/m$^2$ per surface of said steel sheet.

21. A method as claimed in claim 20, wherein:

said diameter of each of said plurality of pores in said iron-zinc alloy electroplating layer as the upper layer is within a range of from 10 to 70 μm.

* * * * *